US011447222B2

(12) United States Patent
Boyer et al.

(10) Patent No.: US 11,447,222 B2
(45) **Date of Patent: *Sep. 20, 2022**

(54) INTERFACE FOR MOUNTING A PROPULSION MECHANISM TO A WATERCRAFT

(71) Applicant: PELICAN INTERNATIONAL INC., Laval (CA)

(72) Inventors: Réjean Boyer, Laval (CA); Vincent Drouin, Laval (CA)

(73) Assignee: PELICAN INTERNATIONAL INC., Québec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/511,494

(22) Filed: Oct. 26, 2021

(65) Prior Publication Data

US 2022/0097814 A1 Mar. 31, 2022

Related U.S. Application Data

(63) Continuation of application No. 17/089,639, filed on Nov. 4, 2020, which is a continuation of application (Continued)

(51) Int. Cl.
*B63H 16/04* (2006.01)
*B63H 16/08* (2006.01)

(Continued)

(52) U.S. Cl.
CPC ..... *B63H 16/08* (2013.01); *B63B 34/20* (2020.02); *B63B 34/26* (2020.02); *B63H 16/04* (2013.01)

(58) Field of Classification Search
CPC .. B63H 16/08; B63H 16/04; B63H 2023/327; B63B 34/26; B63B 34/04; B63B 2035/715; B63B 35/71; B63B 34/20
See application file for complete search history.

(56) References Cited

U.S. PATENT DOCUMENTS 3,376,842 A 4/1968 Wynne
3,982,496 A 9/1976 Blanchard (Continued)

FOREIGN PATENT DOCUMENTS

CN 111055986 A 4/2020
WO WO2019/021062 A1 1/2019

OTHER PUBLICATIONS

Adventure Boats, Race to Alaska, Boats.com, Jul. 23, 2015, by Staff, Jul. 23, 2015, downloaded from https://www.boats.com/on-the-water/adventure-boats-race-to-alaska/, 9 pgs.

(Continued)

*Primary Examiner* — Stephen P Avila

(74) *Attorney, Agent, or Firm* — Morgan, Lewis & Bockius LLP

(57) ABSTRACT

The invention relates to an interface for mounting a propulsion mechanism to a watercraft such as a fishing kayak, and to a watercraft comprising such an interface. The interface comprises a first portion including a first plate with a hole sized and shaped for receiving therethrough a portion of the propulsion mechanism, a second portion including a second plate and one channel extending from the second plate, the channel being in registry with the hole of the first portion for therein a portion of the propulsion mechanism. The interface also comprises fastening assemblies for removably fastening the second portion to the first portion of the interface, and a guiding assembly for maintaining the channel of the second portion in registry with the hole of the first portion.

31 Claims, 32 Drawing Sheets

Related U.S. Application Data

No. 16/287,989, filed on Feb. 27, 2019, now Pat. No. 10,829,189.

(51) Int. Cl.
*B63B 34/20* (2020.01)
*B63B 34/26* (2020.01)

(56) References Cited

U.S. PATENT DOCUMENTS

| | | | |
|---|---|---|---|
| 4,228,751 | A | 10/1980 | Robertson et al. |
| 5,362,264 | A | 11/1994 | Parant |
| 5,460,552 | A | 10/1995 | Blanchard et al. |
| 6,022,249 | A | 2/2000 | Ketterman |
| 6,458,004 | B2 | 10/2002 | Van Breems |
| 6,609,939 | B1 | 8/2003 | Towner et al. |
| 7,007,628 | B1 | 3/2006 | Conley |
| 7,294,031 | B1 | 11/2007 | Davis et al. |
| 7,430,976 | B2 | 10/2008 | Ketterman et al. |
| 7,637,791 | B2 | 12/2009 | Ketterman et al. |
| 7,690,959 | B1 | 4/2010 | Szilagyi et al. |
| 7,867,046 | B1 | 1/2011 | Eichinger |
| 8,011,983 | B1 | 9/2011 | Davis et al. |
| 8,453,589 | B2 | 6/2013 | Czarnowski et al. |
| 8,506,338 | B2 | 8/2013 | Gallato et al. |
| 8,740,662 | B2 | 6/2014 | Gallato et al. |
| 8,753,156 | B2 | 6/2014 | Ketterman et al. |
| 8,869,731 | B2 | 10/2014 | Dow et al. |
| 9,359,052 | B2 | 6/2016 | Ketterman et al. |
| 9,475,559 | B2 | 10/2016 | Czarnowski et al. |
| 9,527,555 | B2 | 12/2016 | Ketterman et al. |
| 9,604,703 | B2 | 3/2017 | Kardas et al. |
| 9,623,944 | B2 | 4/2017 | Kuehmichel et al. |
| 9,701,367 | B2 | 7/2017 | McDonough et al. |
| 9,731,802 | B2 | 8/2017 | Ketterman et al. |
| 9,738,362 | B2 | 8/2017 | Ketterman et al. |
| 9,914,519 | B2 | 3/2018 | Nutz et al. |
| 9,981,726 | B2 | 5/2018 | Ketterman et al. |
| 10,005,531 | B1 | 6/2018 | Broadway et al. |
| 10,220,924 | B1 | 3/2019 | Horvath et al. |
| 10,259,553 | B2 | 4/2019 | Dow et al. |
| 2005/0272321 | A1 | 12/2005 | Mansson |
| 2008/0029010 | A1 | 2/2008 | Ketterman et al. |
| 2008/0029011 | A1 | 2/2008 | Czarnowski et al. |
| 2009/0031941 | A1 | 2/2009 | Czarnowski et al. |
| 2009/0042461 | A1 | 2/2009 | Walton |
| 2010/0025889 | A1 | 2/2010 | Riggins et al. |
| 2016/0121987 | A1 | 5/2016 | Nutt et al. |
| 2018/0001986 | A1 | 1/2018 | Nutz et al. |
| 2018/0009515 | A1 | 1/2018 | Murphy |
| 2020/0269963 | A1 | 8/2020 | Boyer et al. |

OTHER PUBLICATIONS

Boyer, Office Action, U.S. Appl. No. 16/287,989, dated Feb. 4, 2020, 7 pgs.

Boyer, Notice of Allowance, U.S. Appl. No. 16/287,989, dated Jul. 7, 2020, 7 pgs.

"Hobie Cat Company, LLC's Response to Pelican International Inc.'s Complaint for Patent Infringement; and Counterclaims, Case 3:20-cv-023 90-BAS-MSB Document 13 Filed Feb. 11, 2021 PageID. 85, 15 pgs."

Lanxess, Engineering Plastics, Joining Techniques, Copyright © 2005 Lanxess Corporation, 38 pgs.

Lanxess, Engineering Plastics, Parts and Mold Design, Copyright © 2007 Lanxess Corporation, 170 pgs.

*Pelican International Inc., a Canadian corporation*, Plaintiff, v. *Hobie Cat Company, a Missouri corporation, and Hobie Cat Company II, LLC, a Delaware limited liability company*, Defendants and *Hobie Cat Company, a Missouri corporation, and Hobie Cat Company II, LLC, a Delaware limited liability company*, Counterclaimants, v. *Pelican International Inc., a Canadian corporation*, Counterdefendant, Declaration of TY Southerland, dated Jan. 16, 2022, Case No. 20-cv-2390-BAS-MSB, 8 pgs.

*Pelican International Inc., a Canadian corporation*, Plaintiff, v. *Hobie Cat Company, a Missouri corporation, and Hobie Cat Company II, LLC, a Delaware limited liability company*, Defendants and *Hobie Cat Company, a Missouri corporation, and Hobie Cat Company II, LLC, a Delaware limited liability company*, Counterclaimants, v. *Pelican International Inc., a Canadian corporation*, Counterdefendant, Declaration of Robert Morton, dated Jan. 13, 2022, Case No. 20-cv-2390-BAS-MSB, 25 pgs.

Boyer, Office Action, U.S. Appl. No. 17/089,639, dated Feb. 4, 2022, 6 pgs.

*Pelican International Inc.*, Plaintiff, v. *Hobie Cat Company, et al.*, Defendants, Claim Construction Order for U.S. Pat. No. 10,829,189, Case No. 20-cv-2390-BAS-MSB, Document 77 filed Feb. 1, 2022, 71 pgs.

*Pelican International Inc.*, Plaintiff, v. *Hobie Cat Company, a Missouri corporation, and Hobie Cat Company II, LLC*, Defendants and *Hobie Cat Company, and Hobie Cat Company II, LLC*, Counterclaimants, v. *Pelican International Inc.*, Counterdefendant, Public version, Expert Report of Dr. Wendy Sanders, Feb. 11, 2022, 102 pgs.

Public Version, Feb. 11, 2022, Exhibit A Sanders CV, 5 pgs.

Public Version, Feb. 11, 2022, Exhibit B Sanders testimony list—021122.

Public Version, Feb. 11, 2022, Exhibit C List of Materials Considered.

Public Version, Feb. 11, 2022, Appendix A Czarnowski.

Public Version, Feb. 11, 2022, Appendix B Hobie Dinghy.

Public Version, Feb. 11, 2022, Appendix C Raptor G2.

Public Version, Feb. 11, 2022, Appendix D Groeschel.

*Pelican International Inc.* v. *Hobie Cat Company and Hobie Cat Company II, LLC*, Defendants and Counterlclaimants Hobie Cat's Invalidity Contentions, dated May 6, 2021, 55 pgs.

Appendix 1, May 6, 2021, Invalidity Claim Chart re Groeschel Group, 331 pgs.

Appendix 2, May 6, 2021, Invalidity Claim Chart re Czarnowski, 104 pgs.

Appendix 3, May 6, 2021, Invalidity Claim Chart re Dow, 54 pgs.

Appendix 4, May 6, 2021, Invalidity Claim Chart re Lanxess, 189 pgs.

Appendix 5, May 6, 2021, Invalidity Claim Chart re Blanchard, 53 pgs.

Appendix 6—Invalidity Claim Chart re Parant, 26 pgs, May 6, 2021.

Redacted *Pelican International Inc.* v. *Hobie Cat Company and Hobie Cat Company II, LLC*, Defendants and Counterlclaimants Hobie Cat's PLR 3.6(b) Disclosure of Amended Invalidity Contentions, dated Jul. 22, 2021, Case No. 20-cv-2390-BAS-MSB, 59 pgs.

Amended Appendix 1, Jul. 22, 2021, Invalidity Claim Chart re Groeschel, 123 pgs.

Amended Appendix 2, Jul. 22, 2021, Invalidity Claim Chart re Czarnowski, 54 pgs.

Amended Appendix 3, Jul. 22, 2021, Invalidity Claim Chart re Dow, 33 pgs.

Amended Appendix 4, Jul. 22, 2021, Invalidity Claim Chart re Lanxess, 61 pgs.

Amended Appendix 5, Jul. 22, 2021, Invalidity Claim Chart re Blanchard, 22 pgs.

Amended Appendix 6, Jul. 22, 2021, Invalidity Claim Chart re Parant, 25 pgs.

Amended Appendix 7, Jul. 22, 2021, Invalidity Claim Chart re Szilagyi, 103 pgs.

*Pelican International Inc.*, Plaintiff v. *Hobie Cat Company and Hobie Cat Company II, LLC*, Defendants. *Hobie Cat Company and Hobie Cat Company II, LLC*, Counterclaimants, v. *Pelican International Inc.*, Counterdefendant, Rebuttal Expert Report of Dr. Wendy Sanders, dated Mar. 16, 2022, Case No. 20-CV-2390-BAS-MSB, 151 pgs.

*Pelican International Inc., a Canadian corporation*, Plaintiff and Counterdefendant, v. *Hobie Cat Company, a Missouri corporation, and Hobie Cat Company II, LLC, a Delaware limited liability company*, Defendants and Counterclaimants. *Hobie Cat Company,*

(56) References Cited

OTHER PUBLICATIONS

*a Missouri corporation, and Hobie Cat Company II, LLC, a Delaware limited liability company*, Counterclaimants, v. *Pelican International Inc., a Canadian corporation*, Counterdefendant, Rebuttal Expert Report of Dr. Kevin Maki, Mar. 16, 2022, 172 pgs.
*Pelican International Inc.*, Plaintiff v. *Hobie Cat Company and Hobie Cat Company II, LLC*, Defendants. *Hobie Cat Company and Hobie Cat Company II, LLC*, Counterclaimants, v. *Pelican International Inc*., Counterdefendant, Rebuttal Expert Report of Dr. Wendy Sanders Responding To Purported Additional Evidence of Secondary Considerations, dated Mar. 23, 2022, Case No. 20-cv-2390-BAS-MSB, 14 pgs.
*Pelican International Inc.,a Canadian corporation*, Plaintiff v. *Hobie Cat Company, a Missouri corporation, and Hobie Cat Company II, LLC, a Delaware limited liability company*, Defendants, *Hobie Cat Company, a Missouri Corporation, and Hobie Cat Company II, LLC, a Delaware limited liability company*, Counterclaimaints, v. *Pelican International Inc., a Canadian corporation*, Counterdefendant, Defendant Hobie's Notice Pursuant To 35 U.S.C. § 282, Jul. 6, 2022, Case No. 20-cv-2390-BAS-MSB, 10 pgs.
Czarnowski et al., U.S. Appl. No. 60/836,166, "Twist-N-Seal-Hatch," filed Aug. 7, 2006, 19 pgs.
Ketterman et al., U.S. Appl. No. 60/835,271, "Twist and Stow Rudder," filed Aug. 2, 2006, 21 pgs.
Jim Czarnowski, Hobie Dinghy, 2011.
Hobie Inflatable Kayak Range (i9, i12, i11, i14T), 2007.
Hobie, Eclipse Stand-up Pedalboards (ACX, Dura), 2016, 1 pg.
Hobie, Hobie BIC Eclipse, 2016.
Santa Cruz Kayaks Raptor G2 Kayak, 2016.
YouTube video titled "Kayak Fishing—Kayak Review Santa Cruz Raptor G2," Jul. 25, 2016, 30milesOut (also known as Ty Southerland), https://www.youtube.com/watch?v=a94JSRr_u4k, 1 pgs.
YouTube video titled "1st G2 pedal thm," dMay 8, 2016, Jim Martin, https://www.youtube.com/watch?v=thXA1dQ8B4k, 1 pg.
Facebook posts on page titled "Santa Cruz Kayaks," re Raptor G2 Kayak, Mar. 2, 2016, Santa Cruz Kayaks, https://www.facebook.com/SantaCruzKayaks/photos/?ref=page_internal, 8 pgs.
Hobie.com/forum blog post title "Thermoformed Hulls,"Oct. 30, 2013, fusioneng (also known as Robert Morton), https://www.hobie.com/forums/viewtopic.php?f=11&t=49688, 12 pgs.
Hobie.com/forum blog post title New Pelican Pedal Kayak, Jul. 10, 2018, fusioneng (also known as Robert Morton), https://www.hobie.com/forums/viewtopic.php?t=63149, 4 pgs.
Hobie.com/forum blog post titled "New Pelican Pedal Kayak," fusioneng (also known as Robert Morton), Jul. 11, 2018, https://www.hobie.com/forums/viewtopic.php?t=63149, 2 pgs.
Hobie Mirage Drive Users Will Get Over Pelican's HyDryve, FishingTech, Oct. 25, 2018, FishingTech, https://fishingtech.com/blog/tech-news/pelican-hydryve-vs-hobie-mirage-drive/, 2 pgs.
Engineering Plastics Joining Techniques—A Design Guide, Laxness, 2005, Lanxess Corp., https://techcenter.lanxess.com/scp/americas/en/docguard/Joining_Guide.pdf?docId=77016, 38 pgs.
Engineering Plastics Part and Mold Design—A Design Guide, Lanxess, Lanxess Corp., 2007.
Small Craft-Hull Construction and Scantlings, ISO 12215:2008, 2008, International Organization for Standardization, 298 pgs.
Rules for Building and Classing Reinforced Plastic Vessels, 1978, American Bureau of Shipping, 168 pgs.
Outboard Engine Mounting Guide, ABYC TH-12 2017, 2017, The American Boat & Yacht Council, 12 pgs.
Pelican International, Inc., International Search Report and Written Opinion, PCT/IB2022/051658, dated Jun. 15, 2022, 11 pgs.

INTERFACE FOR MOUNTING A PROPULSION MECHANISM TO A WATERCRAFT

CROSS-REFERENCE TO RELATED APPLICATIONS

The current application is a Continuation of U.S. patent application Ser. No. 17/089,639, filed Nov. 4, 2020, entitled "INTERFACE FOR MOUNTING A PROPULSION MECHANISM TO A WATERCRAFT", which is a Continuation of U.S. patent application Ser. No. 16/287,989, filed Feb. 27, 2019, entitled "INTERFACE FOR MOUNTING A PROPULSION MECHANISM TO A WATERCRAFT," now U.S. Pat. No. 10,829,189 which issued on Nov. 10, 2020, which are incorporated by reference in their entirety.

TECHNICAL FIELD

The invention relates to an interface for mounting a propulsion mechanism to a watercraft, and to a watercraft comprising such an interface.

BACKGROUND OF THE ART

Various pedal operated means for propelling watercrafts such as kayaks have been proposed in the past. Such foot propulsion mechanisms are becoming increasingly popular in fishing kayaks since the user can propel its watercraft using feet while the hands remain available for holding fishing rods and the like.

For instance, U.S. Pat. No. 6,022,249 discloses a rigid watercraft made of polyethylene and including a foot propulsion mechanism. The propulsion mechanism comprises a pair of flappers adapted to oscillate through arcuate paths in a generally transverse direction with respect to the central longitudinal dimension of the watercraft. Pedals are operatively associated with the propulsion means for applying input force to the propulsion means, and the propulsion mechanism is mounted to a receptacle defined in the hull or body of the kayak. As such, the propulsion mechanism is directly supported by the hull of the kayak. While this configuration may be suitable in many instances, the reciprocating movement induced on the pedals tends to urge slight movement of the foot propulsion mechanism relative to the hull of the kayak, which may cause damages to the hull over time. Since the hull itself defines the support for the foot propulsion mechanism, the entire hull must be replaced when such damages occur. Furthermore, the manufacturing of such hull by thermoforming may prove onerous since the crafting of the receptacle for the propulsion mechanism typically requires a worker to carefully cut out the opening for receiving the foot propulsion mechanism, which tends to slow down the manufacturing process.

In other instances, the rigidity of the hull is not sufficient to support such a foot propulsion mechanism. In such instances, a rigid interface between the hull and the foot propulsion mechanism can be provided. For instance, U.S. Pat. No. 8,082,871 describes an interface for an inflatable watercraft, where the inflatable watercraft comprises an opening defined in the center and extending through the bottom or floor of an air chamber. The opening is adapted for receiving an oval interface, which is itself adapted to receive a foot operated propulsion mechanism. The interface is a unitary component of generally oval shape having generally vertical side walls running completely around the oval, the top and bottom of the oval being open. The upper and lower extremities of the walls terminate in upper and lower outwardly projecting flanges, and the space between the flanges receives and abuts the oval opening, the oval opening and interface being complementary sized and shaped. The interface is normally fairly rigid and is made of an injection moldable plastic.

While such interface may be suitable with inflatable watercrafts, its unitary structure renders it difficult to use with watercrafts comprising rigid bodies. Rigid watercrafts such as kayaks may be manufactured by molding two sheets of extrudable material using a thermoforming process to shape the two manufactured sheets into a kayak shape, one sheet being used for the top side (i.e. the deck) and the other for the bottom side (i.e. the hull) of the kayak. Manufacturing the body using such a process may lead to slight inherent manufacturing variation of the thickness of the body, which thickness variation may represent a challenge for manufacturing and assembling components having a single size and shape, such as the interface for propulsion mechanisms disclosed in U.S. Pat. No. 8,082,871.

Therefore, it would be desirable to be provided with an interface for a watercraft that alleviates at least some of the above-identified drawbacks.

SUMMARY

According to a broad aspect, there is provided an interface for mounting a propulsion mechanism to a watercraft including a rigid body having a deck portion, a hull portion and a well extending between the deck portion and the hull portion. In this broad aspect, the interface comprises:

- a first portion including a first plate positionable adjacent to one of the hull portion and the deck portion of the watercraft, about the periphery of the well, and at least one channel extending from the second plate, the channel being positionable in the well, in registry with the hole of the first portion, the channel being sized and shaped for receiving therein a portion of the propulsion mechanism and for mounting the propulsion mechanism to the interface; and
- at least one fastening assembly for removably fastening the first portion to the body of the watercraft.

In one feature, the interface further comprises a second portion including a second plate positionable adjacent to the other of the hull portion and the deck portion of the watercraft, about the periphery of the well, the second plate comprising a hole sized and shaped for receiving therethrough a portion of the propulsion mechanism. In this feature, the hole is positionable in registry with the well, and the at least one fastening assembly is further configured for removably fastening the second portion of the interface to the body of the watercraft.

In another feature, the first portion is a top portion and the first plate is a top plate, and wherein the second portion is a bottom portion and the second plate is a bottom plate.

In yet another feature, the channel is adapted for removably securing the propulsion mechanism to the interface.

In still another feature, the at least one fastening assembly is configured for removably fastening the first portion to the second portion of the interface. Preferably, the at least one fastening assembly includes a first segment engaging the first portion of the interface and a second segment engaging the second portion of the interface. The first and second segments of the at least one fastening assembly collaborate to force the first and second portions of the interface toward one another to sandwich the body of the watercraft between the first and second plates.

In a further feature, the first segment of the at least one fastening assembly comprises a threaded fastener engaging the first plate of the first portion and the second segment of the at least one fastening assembly comprises a fastening projection provided with a threaded hole, the threaded fastener being engageable in the threaded hole of the fastening projection to force the first and second portions of the interface toward one another.

In yet a further feature, the at least one fastening assembly is further configured for maintaining the channel of the first portion in registry with the hole of the second portion when the at least one fastening assembly is fastened and the channel is spaced-apart from the second plate.

In still a further feature, the at least one fastening assembly comprises four fastening assemblies.

In one feature, the interface further comprises at least one guiding assembly for maintaining the channel of the first portion in registry with the hole of the second portion when the at least one fastening assembly is fastened and the channel is spaced-apart from the second plate. Preferably, the at least one guiding assembly comprises a plurality of fins extending upwardly from the second plate of the second portion, about the periphery of the hole, the fins being configured for positioning the channel of the first portion in registry with the hole of the second portion as the first and second portions of the interface are forced toward one another.

In one feature, the fins extend from at least one of a ridge extending upwardly from the second plate of the second portion, a female portion of a guide assembly and the second segment of the second portion.

In another feature, the at least one guiding assembly comprises a guiding assembly mounted to the at least one fastening assembly.

In still another feature, the propulsion mechanism is a foot propulsion mechanism.

In yet another feature, the propulsion mechanism is an oscillating flapper propulsion mechanism.

In a further feature, the propulsion mechanism is a motorised propulsion mechanism.

In still a further feature, the watercraft is a kayak, and preferably a fishing kayak.

In another feature, the watercraft is a small boat.

In a further feature, the interface further comprises a lock mechanism for removably securing the propulsion mechanism to the interface. Preferably, the lock mechanism is mounted in the channel of the first portion of the interface. More preferably, the propulsion mechanism comprises a shaft including at least projection on one side of the propulsion mechanism, and the channel comprises at least one recess for slidably receiving therein the at least one shaft projection. The lock mechanism is positioned in the channel adjacent to the recess and being movable between a lock position and an unlock position, the lock mechanism in lock position engaging the shaft projection received in the recess to prevent vertical movement of the propulsion mechanism relative to the channel.

According to another broad aspect, there is provided a watercraft comprising:

rigid body having a deck portion, a hull portion and a well extending between the deck portion and the hull portion, an interface for mounting a propulsion mechanism to the body of the watercraft, the interface including:

a first portion including a first plate positionable adjacent to one of the hull portion and the deck portion of the watercraft, about the periphery of the well, and at least one channel extending from the first plate, the channel being positionable in the well, the channel being sized and shaped for receiving therein a portion of the propulsion mechanism and for mounting the propulsion mechanism to the interface; and at least one fastening assembly for removably fastening the first portion to the body of the watercraft.

In one feature, the interface further comprises a second portion including a second plate positionable adjacent to the other of the hull portion and the deck portion of the watercraft, about the periphery of the well, the second plate comprising a hole sized and shaped for receiving therethrough a portion of the propulsion mechanism. In this feature, the hole is positionable in registry with the well, and the at least one fastening assembly is further configured for removably fastening the second portion of the interface to the body of the watercraft.

In another feature, the first portion is a top portion and the first plate is a top plate, and wherein the second portion is a bottom portion and the second plate is a bottom plate.

In yet another feature, the channel is adapted for removably securing the propulsion mechanism to the interface.

In still another feature, the at least one fastening assembly is configured for removably fastening the first portion to the second portion of the interface. Preferably, the at least one fastening assembly includes a first segment engaging the first portion of the interface and a second segment engaging the second portion of the interface. The first and second segments of the at least one fastening assembly collaborate to force the first and second portions of the interface toward one another to sandwich the body of the watercraft between the first and second plates.

In a further feature, the first segment of the at least one fastening assembly comprises a threaded fastener engaging the first plate of the first portion and the second segment of the at least one fastening assembly comprises a fastening projection provided with a threaded hole, the threaded fastener being engageable in the threaded hole of the fastening projection to force the first and second portions of the interface toward one another.

In yet a further feature, the at least one fastening assembly is further configured for maintaining the channel of the first portion in registry with the hole of the second portion when the at least one fastening assembly is fastened and the channel is spaced-apart from the second plate.

In still a further feature, the at least one fastening assembly comprises four fastening assemblies.

In one feature, the interface further comprises at least one guiding assembly for maintaining the channel of the first portion in registry with the hole of the second portion when the at least one fastening assembly is fastened and the channel is spaced-apart from the second plate. Preferably, the at least one guiding assembly comprises a plurality of fins extending upwardly from the second plate of the second portion, about the periphery of the hole, the fins being configured for positioning the channel of the first portion in registry with the hole of the second portion as the first and second portions of the interface are forced toward one another.

In one feature, the fins extend from at least one of a ridge extending upwardly from the second plate of the second portion, a female portion of a guide assembly and the second segment of the second portion.

In another feature, the at least one guiding assembly comprises a guiding assembly mounted to the at least one fastening assembly.

In still another feature, the propulsion mechanism is a foot propulsion mechanism.

In yet another feature, the propulsion mechanism is an oscillating flapper propulsion mechanism.

In a further feature, the propulsion mechanism is a motorised propulsion mechanism.

In still a further feature, the watercraft is a kayak, and preferably a fishing kayak.

In another feature, the watercraft is a small boat.

In a further feature, the interface further comprises a lock mechanism for removably securing the propulsion mechanism to the interface. Preferably, the lock mechanism is mounted in the channel of the first portion of the interface. More preferably, the propulsion mechanism comprises a shaft including at least projection on one side of the propulsion mechanism, and the channel comprises at least one recess for slidably receiving therein the at least one shaft projection. The lock mechanism is positioned in the channel adjacent to the recess and being movable between a lock position and an unlock position, the lock mechanism in lock position engaging the shaft projection received in the recess to prevent vertical movement of the propulsion mechanism relative to the channel.

According to another broad aspect, there is provided an interface for mounting a propulsion mechanism to a watercraft including a rigid body having a deck portion, a hull portion and a well extending between the deck portion and the hull portion. In this broad aspect, the interface comprises:

a first portion including a first plate positionable adjacent to one of the hull portion and the deck portion of the watercraft, about the periphery of the well, and at least one channel extending from the first plate, the channel being positionable in the well, the channel being sized and shaped for receiving therein a portion of the propulsion mechanism and for mounting the propulsion mechanism to the interface;

a second portion including a second plate positionable adjacent to the other of the hull portion and the deck portion of the watercraft, about the periphery of the well, the second plate comprising a hole sized and shaped for receiving therethrough a portion of the propulsion mechanism, the hole being positionable in registry with the well and with the channel of the first portion;

at least one fastening assembly for removably fastening the second portion to the first portion of the interface, the at least one fastening assembly including a first segment engaging the first portion of the interface and a second segment engaging the second portion of the interface, the first and second segments of the at least one fastening assembly collaborating to force the first and second portions of the interface toward one another to sandwich the body of the watercraft between the first and second plates;

at least one guiding assembly for maintaining the channel of the first portion in registry with the hole of the second portion when the at least one fastening assembly is fastened and the channel is spaced-apart from the first plate.

According to yet another broad aspect, there is provided a watercraft comprising:

rigid body having a deck portion, a hull portion and a well extending between the deck portion and the hull portion, an interface for mounting a propulsion mechanism to the body of the watercraft, the interface including:

a first portion including a first plate positionable adjacent to one of the hull portion and the deck portion of the watercraft, about the periphery of the well, and at least one channel extending from the first plate, the channel being positionable in the well, the channel being sized and shaped for receiving therein a portion of the propulsion mechanism and for mounting the propulsion mechanism to the interface;

a second portion including a second plate positionable adjacent to the other of the hull portion and the deck portion of the watercraft, about the periphery of the well, the second plate comprising a hole sized and shaped for receiving therethrough a portion of the propulsion mechanism, the hole being positionable in registry with the well and with the channel of the first portion;

at least one fastening assembly for removably fastening the second portion to the first portion of the interface, the at least one fastening assembly including a first segment engaging the first portion of the interface and a second segment engaging the second portion of the interface, the first and second segments of the at least one fastening assembly collaborating to force the first and second portions of the interface toward one another to sandwich the body of the watercraft between the first and second plates;

at least one guiding assembly for maintaining the channel of the first portion in registry with the hole of the second portion when the at least one fastening assembly is fastened and the channel is spaced-apart from the first plate.

BRIEF DESCRIPTION OF THE DRAWINGS

Having thus generally described the nature of the invention, reference will now be made to the accompanying drawings, showing by way of illustration example embodiments thereof and in which.

DETAILED DESCRIPTION

FIGS. 1 to 7 show an example of a watercraft in accordance with an embodiment of the invention. In this embodiment, the watercraft is a fishing kayak 10 comprising a body 12 having a bow end 14 and a stern end 16 opposite the bow end 14. The body 12 extends along a longitudinal axis $L_1$-$L_1$ from the bow end 14 to the stern end 16. The kayak 10 has a length L defined by the longitudinal axis $L_1$-$L_1$, a width W transversal to the longitudinal axis $L_1$-$L_1$, and a height H transversal to the widthwise and longitudinal directions. As the kayak 10 is primarily designed for fishing, the body 12 of the kayak 10 may be made relatively wide to assist in providing increased stability to the watercraft.

Figure 5:
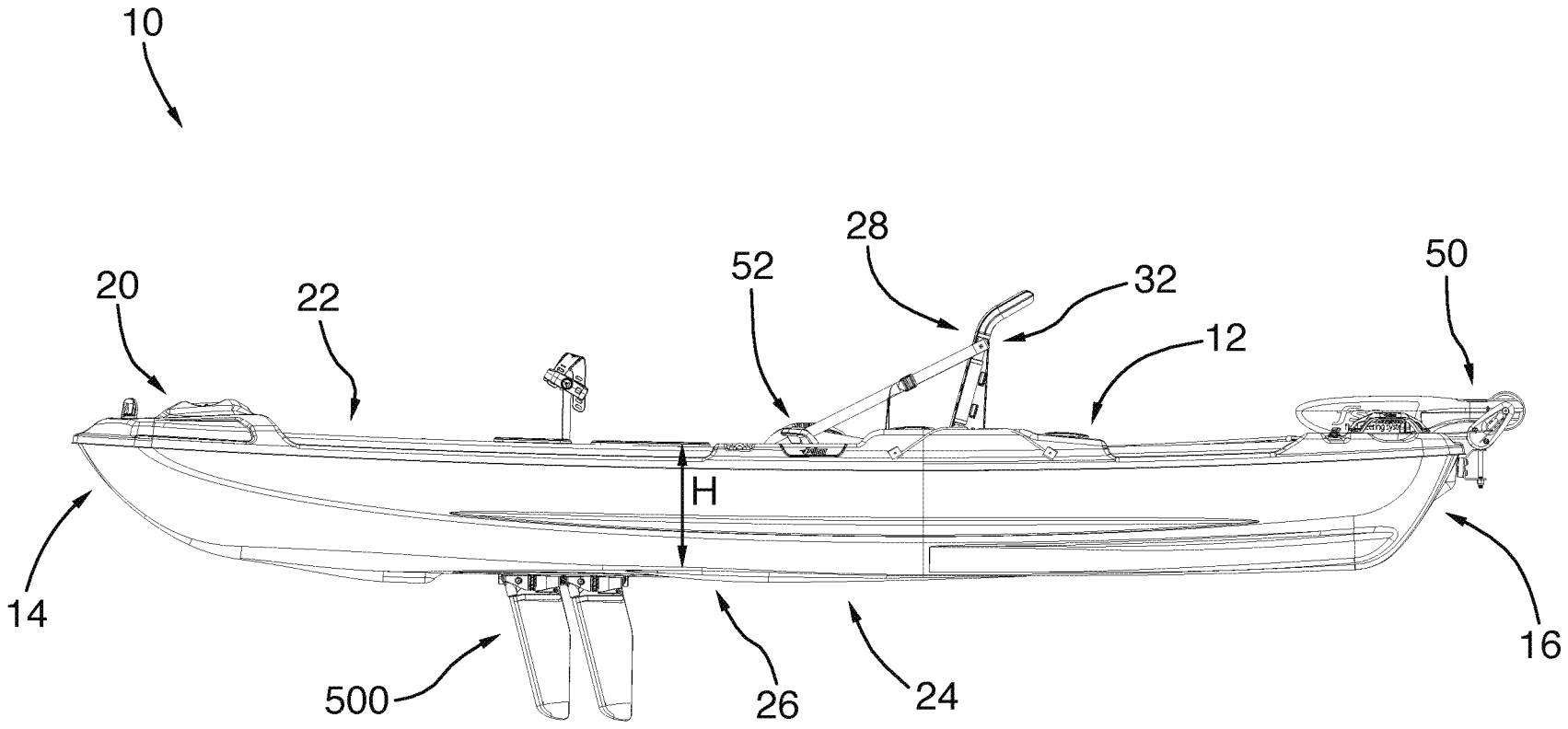
FIG. 5 is a left elevation view of the kayak shown in FIG. 1.
Figure 6:
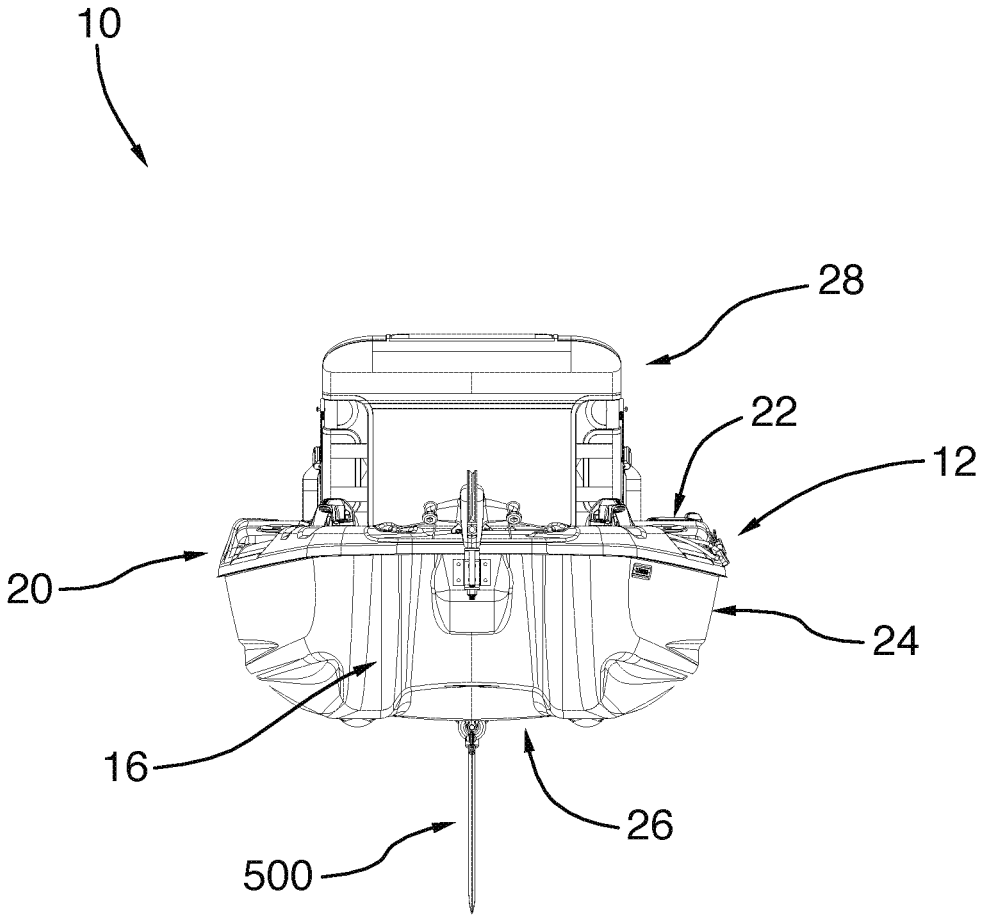
FIG. 6 is a rear elevation view of the kayak shown in FIG. 1.

The body 12 of the kayak 10 comprises a deck 20 defining a top side 22 of the body 12 and a hull 24 defining a bottom side 26 of the body 12 (best shown in FIG. 5). The deck 20 is configured for accommodating a user of the kayak 10 while the hull 24 is configured to engage water onto which the kayak 10 floats and travels.

In the illustrated embodiment, the deck 20 is provided with various features that can be useful to the user. For example, in the embodiment depicted, a seat 28 is disposed atop the deck 20 for allowing a user of the fishing kayak 10 to sit in a generally upright position. The seat 28 comprises a seat bottom 30 and a backrest 32. The deck 20 also comprises a leg area 34 located forwardly of the seat 28 for supporting the user's legs and feet. In this embodiment, the leg area 34 comprises a generally oblong well 100 mounted in an oblong (best shown in FIGS. 9 to 10) defined in the body 12, an interface 300 mounted in the well 100 and a foot propulsion mechanism 500 mounted to the interface 300, for allowing a user seating on the seat 28 to propel the kayak 10, as it will be described in greater details below. The leg area 34 may also be used for the user to stand while fishing. It will be understood that such features may not necessarily be found in conventional (i.e., recreational/non-fishing) kayaks, or that such features may be configured differently without departing from the scope of this embodiment.

In this embodiment, the deck 20 also comprises a covered storage compartment 36 adjacent the bow end 14 of the body 12 and an open storage compartment 38 located between the covered storage compartment 36 and the leg area 34.

The deck 20 also comprises covered storage compartment 40 adjacent the stern end 16 of the body 12, as well as an open compartment 42 located between the covered storage compartment 40 and the seat 28. As it will be appreciated, storage compartments 36, 38, 40 and 42 may be useful to store equipment and, in the case of the covered storage compartments 36 and 40, to protect such equipment from exposure to water. The open storage compartments 38, 42 may comprise securing cords 44, 46 (such as for example bungee cords) to secure equipment in the open storage compartments 38, 42. As an example, a cooler or other equipment and/or provisions useful for fishing may be secured in the open storage compartments 38, 42.

At the stern end 16 of the deck 20, the kayak 10 is provided with a rudder assembly 50. The rudder assembly 50 is operatively coupled to a steering mechanism 52 located beside the seat 28 (in the illustrated embodiment, on the left side of the seat 28) via a cable transmission (not shown), for steering the kayak 10. Furthermore, in the embodiment depicted, the deck 20 comprises three pole holders 56, 58 and 60 for holding fishing poles (not shown). The deck 20 also comprises a pair of paddle parks 62, 64 on each side of the seat 28 to securely hold paddles (not shown) generally parallel to the longitudinal axis $L_1$-$L_1$ of the kayak 10.

Figure 1:
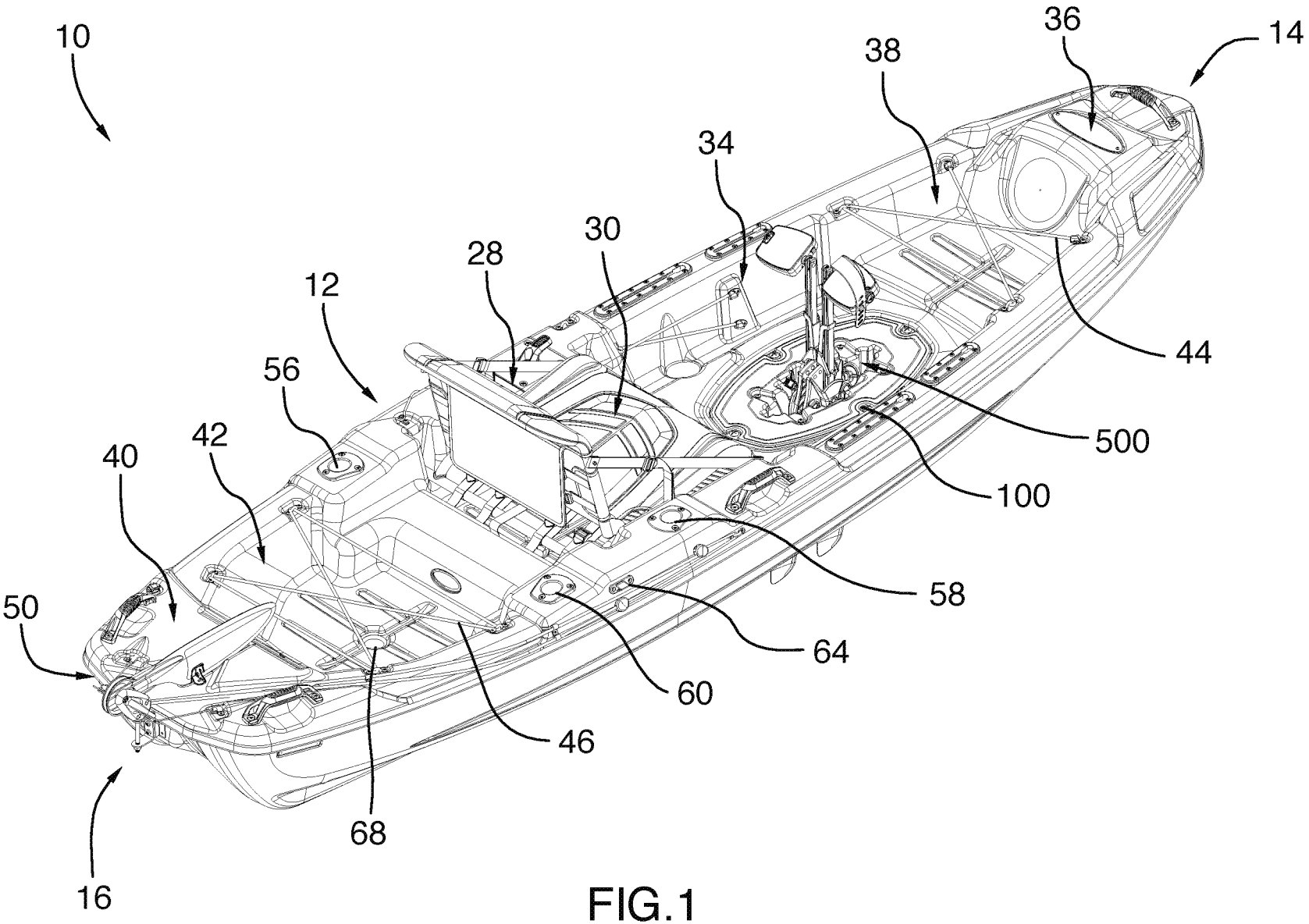
FIG. 1 is a top, rear right perspective view of a kayak in accordance with one embodiment.
Figure 2:
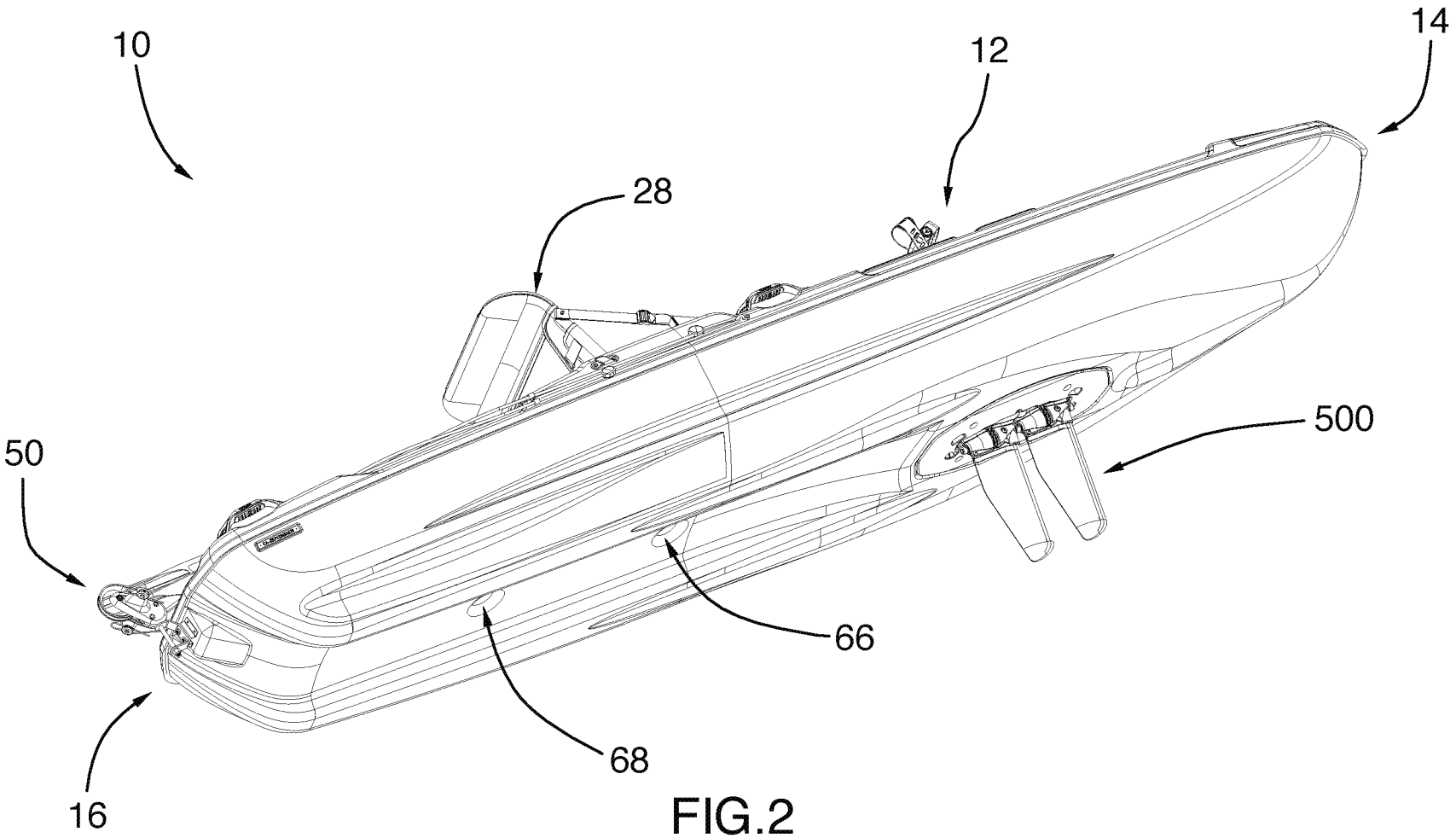
FIG. 2 is a bottom, rear right perspective view of the kayak shown in FIG. 1.
Figure 3:
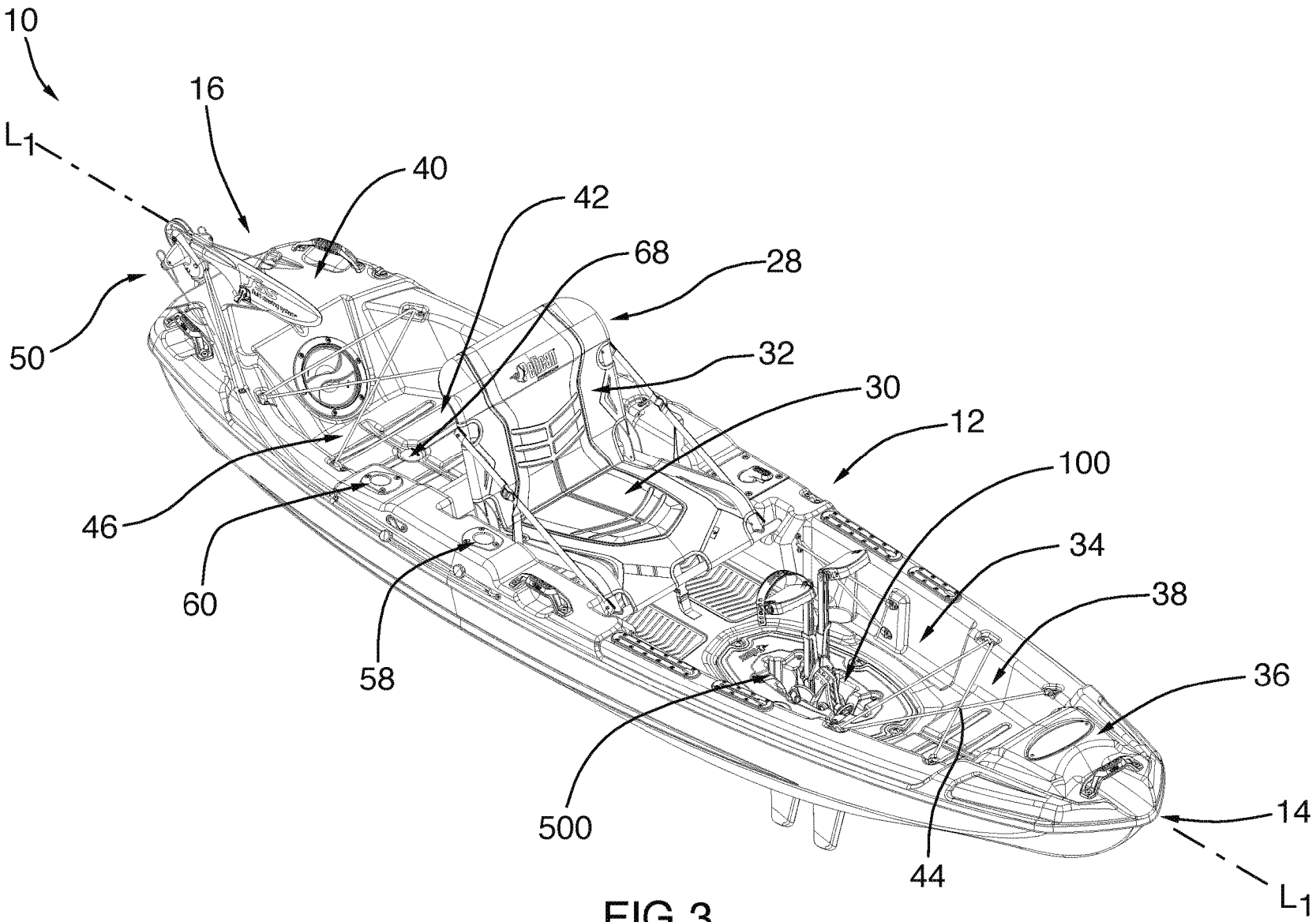
FIG. 3 is a top, front right perspective view of the kayak shown in FIG. 1.
Figure 4:
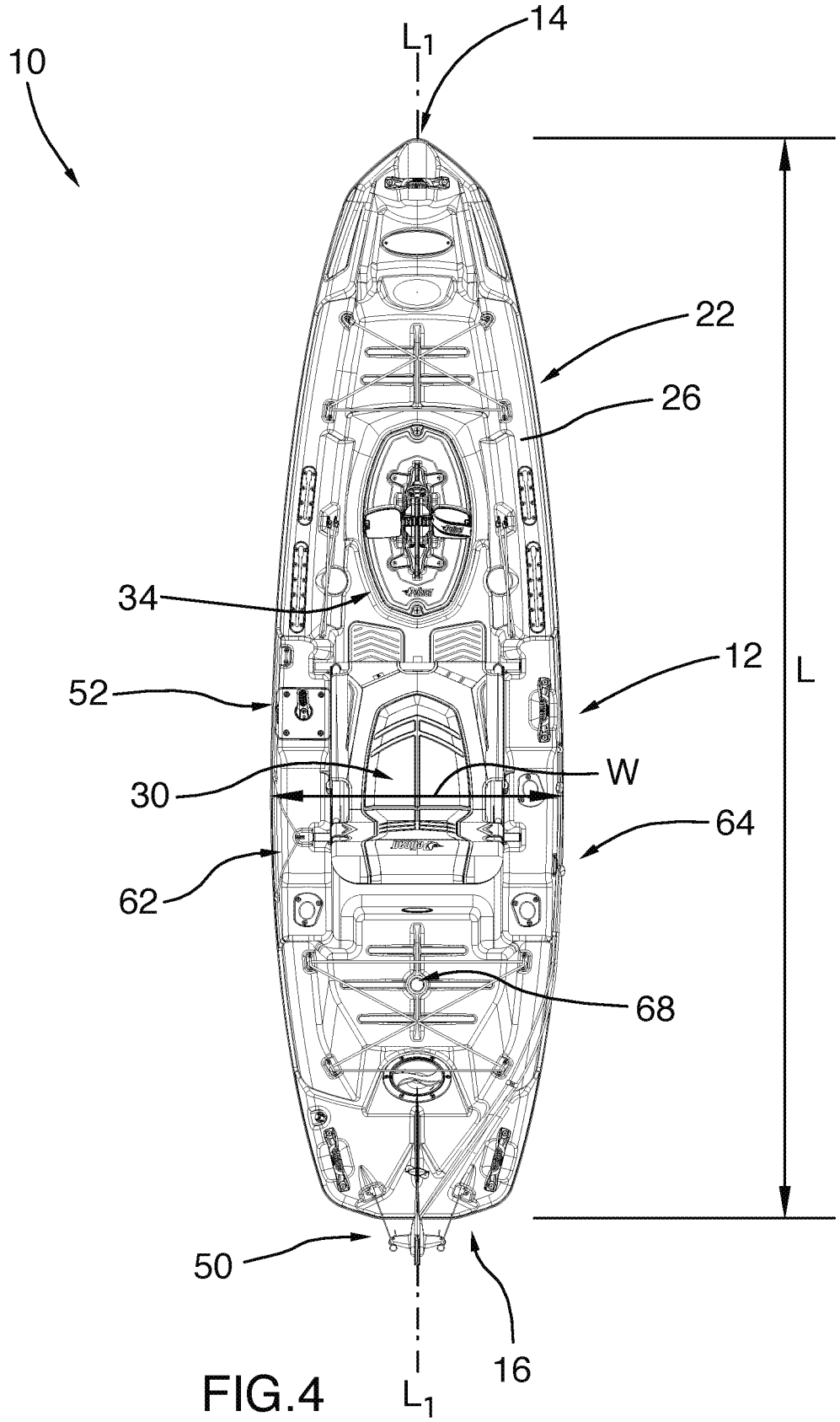
FIG. 4 is a top plan view of the kayak shown in FIG. 1.
Figure 7:
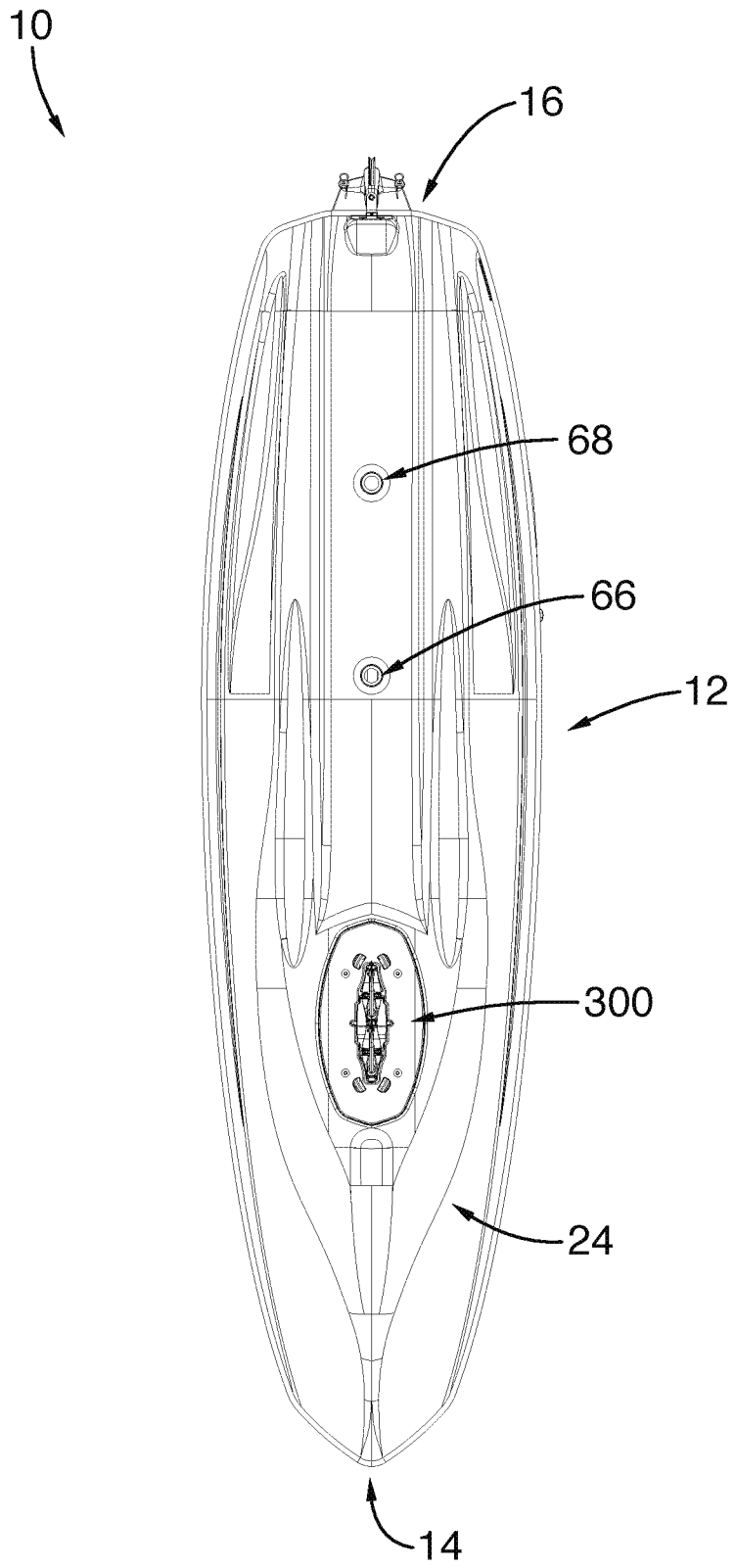
FIG. 7 is a bottom plan view of the kayak shown in FIG. 1.

With reference to FIGS. 1, 2 and 7, the body 12 of the kayak 10 is also shown as comprising a pair of drainage holes 66, 68 through which water from the deck 20 may travel to the bottom side 26 of the body 12 and into a body of water on which the kayak 10 travels.

Defined in the leg portion 34 of the body 12, and extending between the deck 20 and the hull 24, is the generally oblong well configured for receiving therein the interface 300 for mounting a foot operated propulsion mechanism 500.

Figure 8:
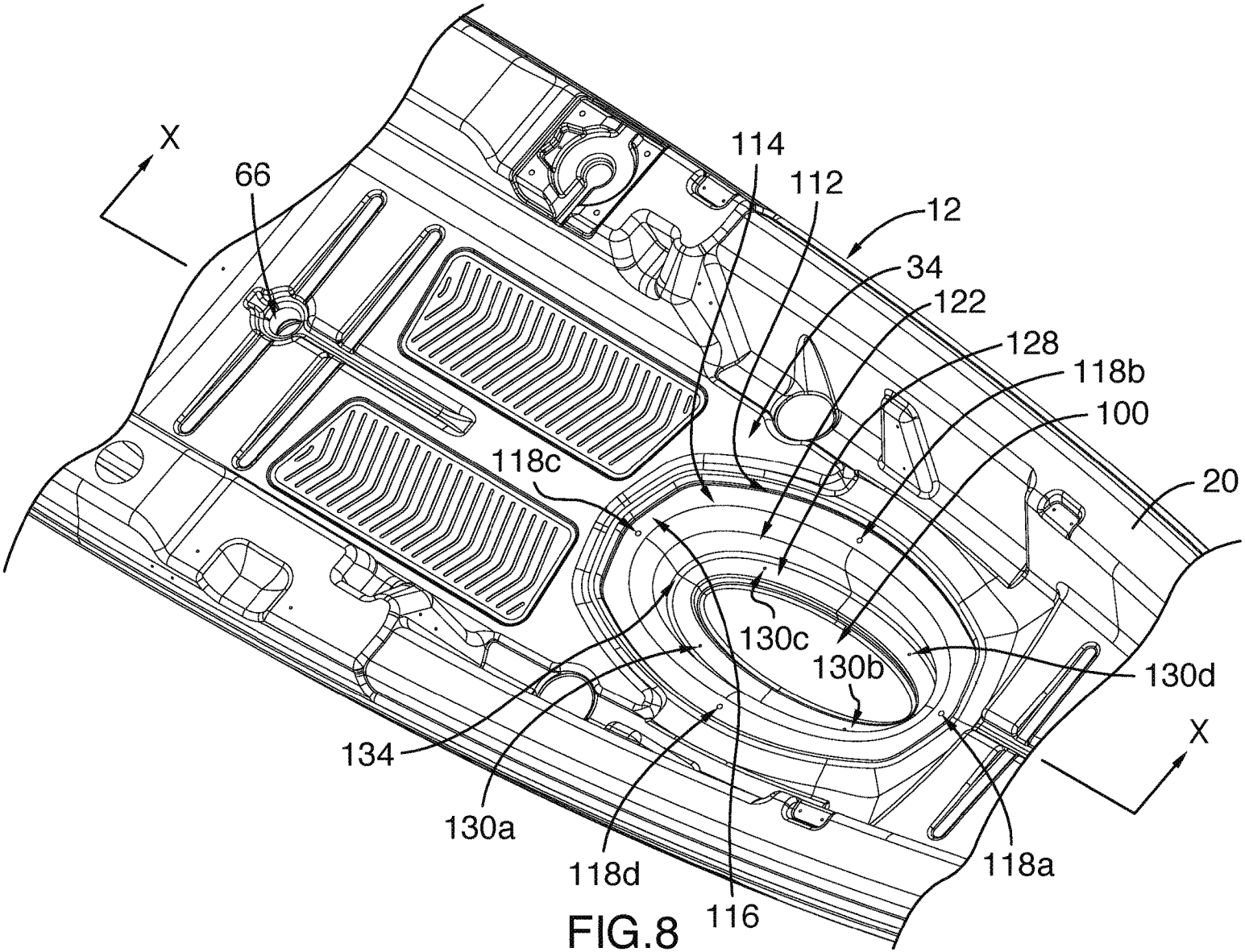
FIG. 8 is an enlarged, top front right perspective view of a body of the kayak shown in FIG. 1, in accordance with one embodiment.
Figure 9:
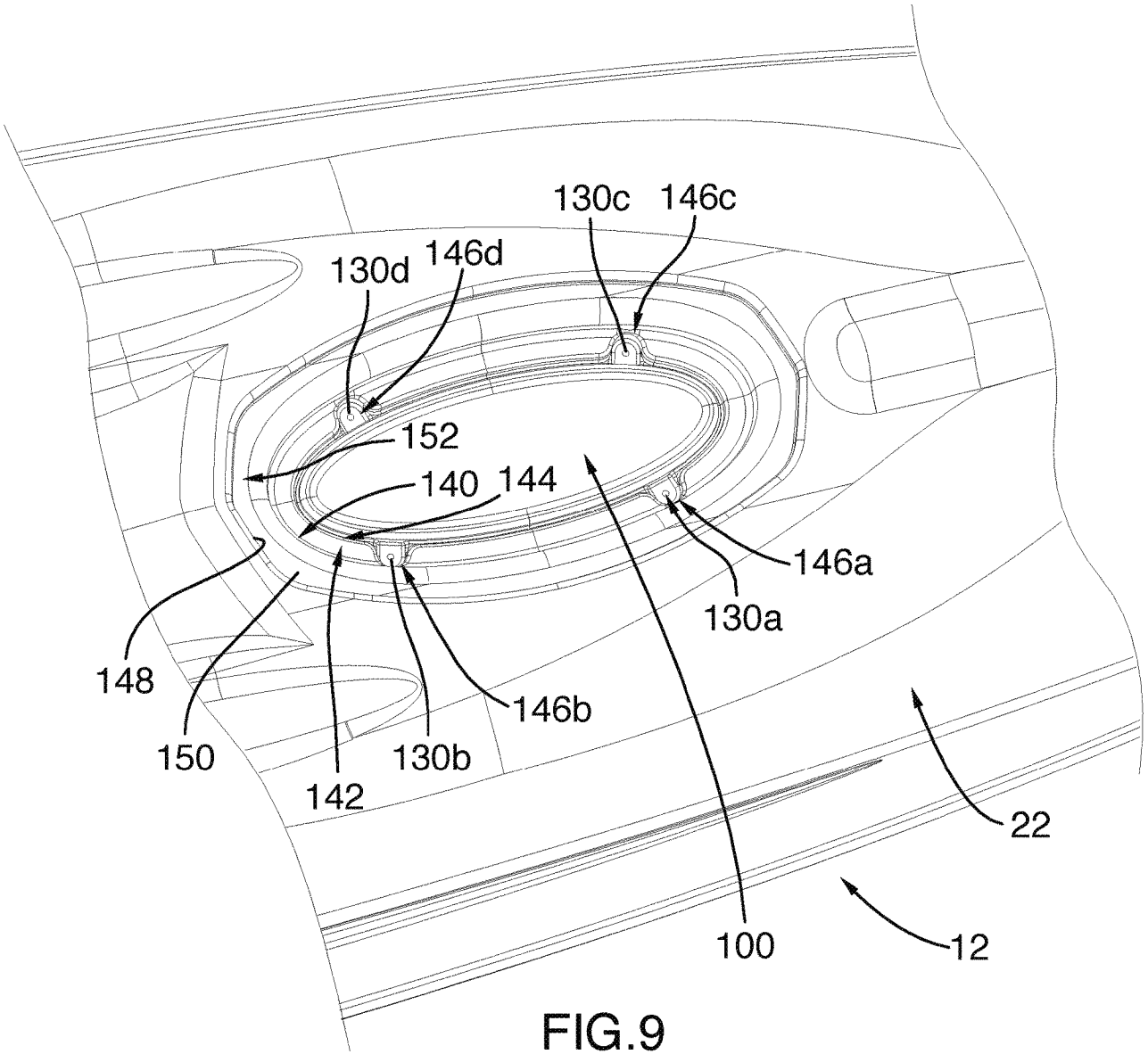
FIG. 9 is an enlarged, bottom front right perspective view of the body shown in FIG. 8.
Figure 10:
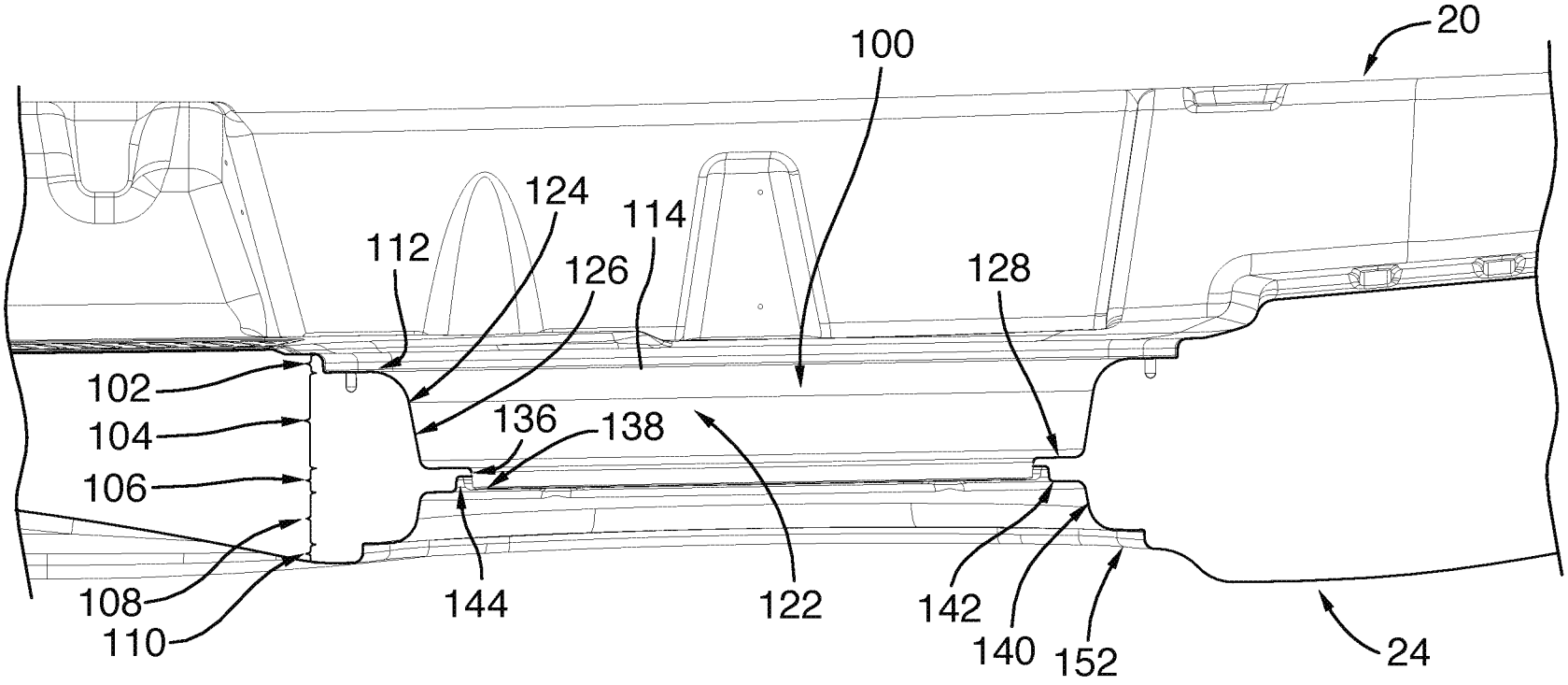
FIG. 10 is a cross-section view of the body shown in FIG. 8, taken along line X-X.
Figure 11:
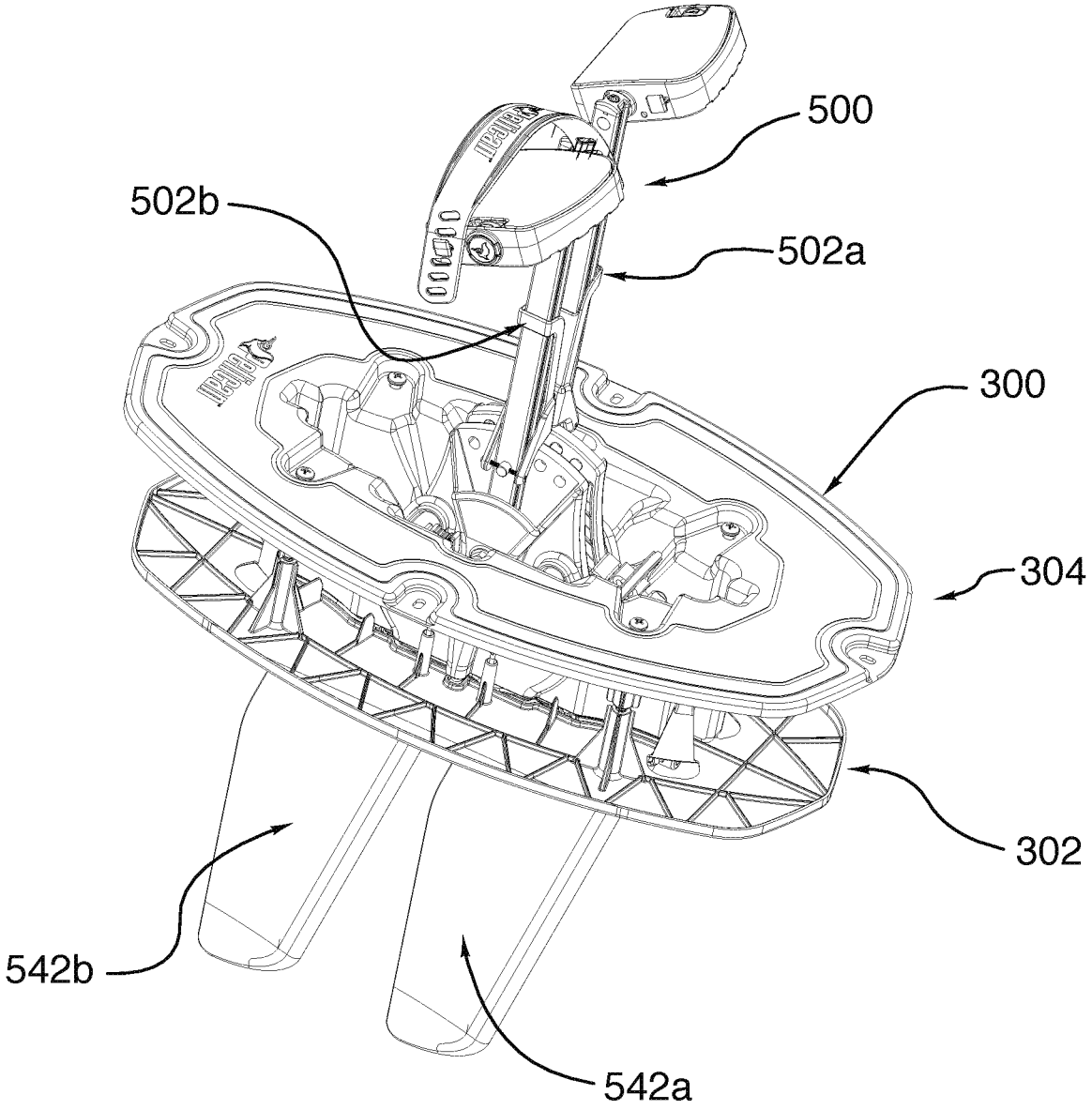
FIG. 11 is a top, front right perspective view of an interface and a propulsion mechanism mounted thereto of the kayak shown in FIG. 1, in accordance with one embodiment.
Figure 12:
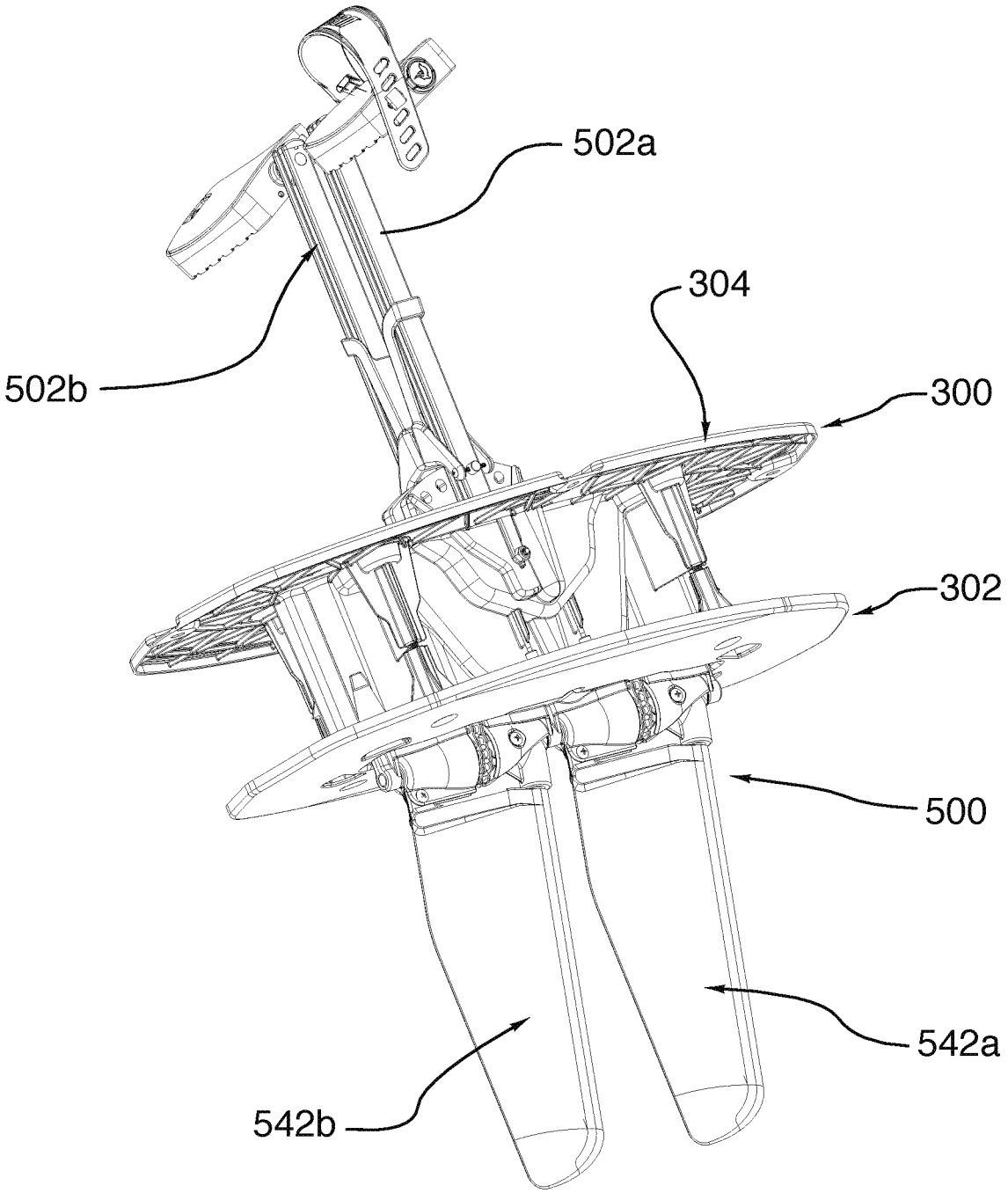
FIG. 12 a bottom, rear right perspective view of the interface and propulsion mechanism shown in FIG. 11.
Figure 13:
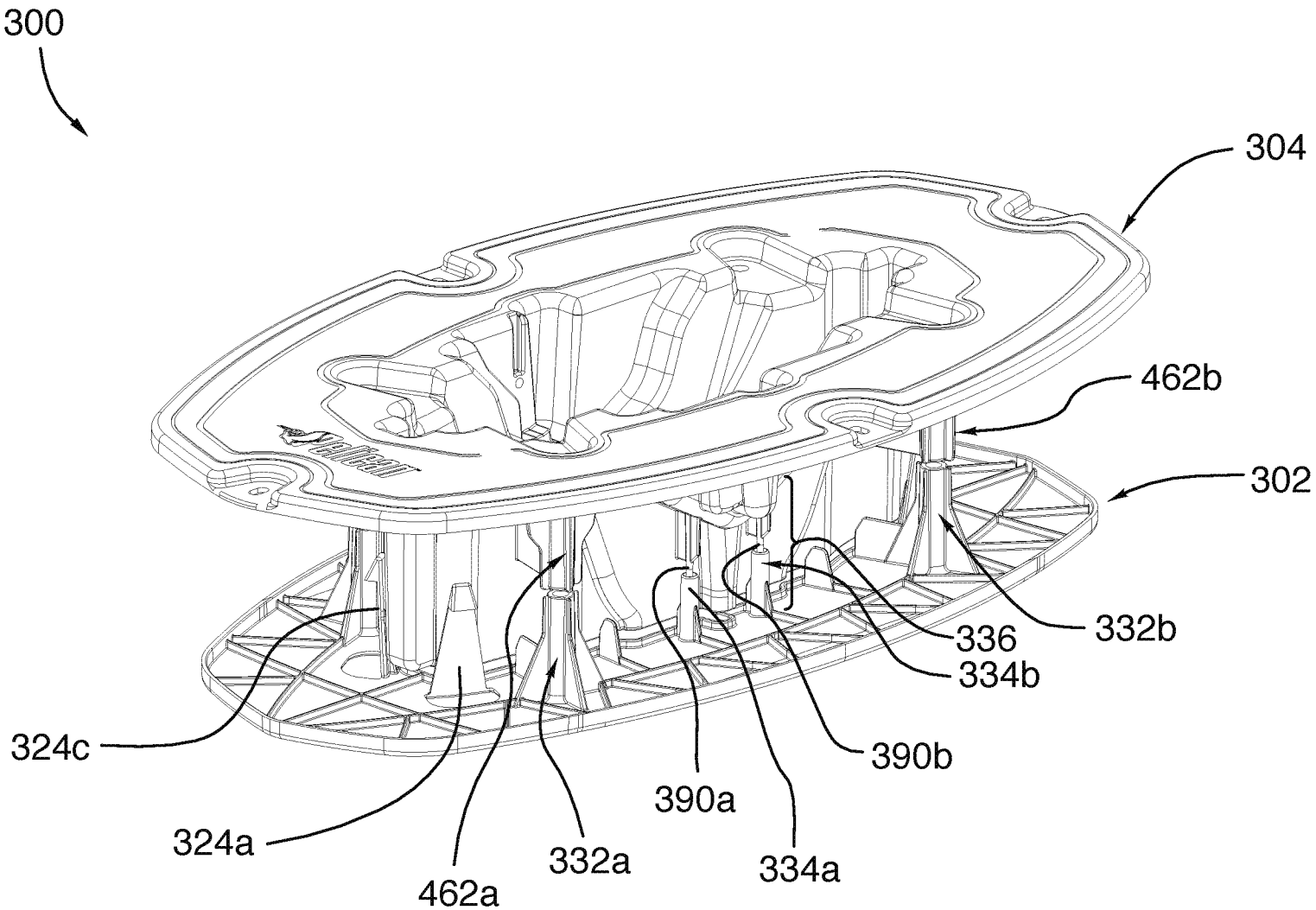
FIG. 13 is a top, rear right perspective view of the interface shown in FIG. 11.

With reference to FIGS. 8 to 10, the well 100 comprises first, second, third, fourth and fifth portions 102, 104, 106, 108 and 110, respectively which sequentially extend from the deck 20 to the hull 24. The first portion 102 comprises a peripheral wall 112 and a first abutment wall 114 extending perpendicular thereto. Together, the peripheral wall 112 and the first abutment wall 114 define a recess 116 sized and shaped for receiving therein a portion of the interface 300, as it will become apparent below. Defined in the first abutment wall 114 are four holes 118*a*-118*d* for receiving therein threaded fasteners 120*a*-120*d* (shown in FIG. 31), for securing a portion of the interface 300 to the body 12 of the kayak 10, as it will become apparent below. The second portion 104 of the well 100 is located below the first portion 102. The second portion 104 comprises a peripheral wall 122 having a top end 124 connected to the abutment wall 114 of the first portion 102, the top end 124 being curved to transition toward a lower end 126 which, extends at an angle of approximately 80 degrees relative to the horizontal. The lower end 126 of the peripheral wall 122 is connected to a second abutment wall 128. The second abutment wall 128 extends generally horizontal, and comprises a plurality of holes 130*a*-130*d* for receiving therethrough a corresponding plurality of threaded fasteners 132*a*-132*d* (shown in FIG. 31) for securing portion of the interface 300 to the body 12 of the kayak 10, as it will become apparent below. Together, the peripheral wall 122 and the second abutment wall define 128 a second recess 134 for receiving a portion of the interface 300, as it will become apparent below.

The third portion 106 of the well 100 also includes a peripheral wall 136 extending downwardly, as well as a lip 138 extending generally transverse to the peripheral wall 136. The peripheral wall 136 and the lip 138 correspond to the junction between the deck portion 20 of the body 12 and the hull 24, where they are welded of fused together during the manufacturing process.

Likewise, and referring to FIGS. 9 and 10, the fourth portion 108 of the well 100 includes a peripheral wall 140, as well as an abutment wall 142 extending generally horizontal. Defined on the abutment wall 142 is an oblong channel 144 adjacent to the lip 138, and four recesses 146*a*-146*b* for receiving therein portion of the interface 300, as it will become apparent below.

Lastly, and referring to FIG. 9, the fifth portion 110 comprises a peripheral wall 148 and an abutment wall 150. Together, the peripheral wall 148 and the abutment wall 150 define a recess 152 for receiving therein a portion of the interface 300, as it will become apparent below.

Tuning now to FIGS. 11 to 26, the interface 300 will now be described. The interface 300 comprises a bottom portion 302 and a top portion 304 configured to collaborate with the bottom section 302 to conceal the well 100 of the body 12 regardless of any manufacturing variations which may affect the thickness of the body 12 in this location, and to operatively accommodate the foot propulsion mechanism 500.

With reference to FIGS. 16A to 20, the bottom portion 302 comprises a plate 306 having a top face 308 and a bottom face 310, the bottom plate 302 being sized and shape to fit in the recess 152 defined by the fifth portion 110 of well 100 defined in the body 12 of the kayak 10. Defined at the center of the bottom plate 306 is an elongated hole 312 sized and shaped for allowing the passage of a portion of the propulsion mechanism 500, the elongated hole 312 being surrounded by an inner peripheral wall 314 extending upwardly from the top face 308. Also extending upwardly from the top face 308 of the plate 306 is a generally vertical outer peripheral wall 316, located on the periphery of the plate 306, as well as a plurality of reinforcement ridges 318, 320, 322 connecting the inner and outer peripheral walls 314, 316 (only some of the reinforcement ridges being identified with reference numerals 318, 320 and 322) Together with the inner and outer peripheral walls 314, 316, the reinforcement ridges 318, 320, 322 contribute to provide the plate 306 with additional rigidity to torsion and/or bending.

Four snap hooks or snapfits 324*a*-324*d* also extend vertically from the top face 308 of the plate 306. The snapfits 324*a*-324*d* are located proximal to the inner peripheral wall 314 and the elongated hole 312, and each comprises a vertical base 326*a*-326*d* and a hook portion 328*a*-328*d*. When the bottom portion 302 of the interface 300 is properly positioned in the oblong well 100 of the body 12, the plate 306 is received in the recess 152 defined by the peripheral and abutment walls 148, 150 of the fifth portion 110, and the snapfits 324*a*-324*d* extend to engage the lip 138 of the third portion 106. As such, the snapfits 324*a*-324*d* contribute to maintain the position of the bottom portion 302 of the interface 300 in position relative to the body 12 of the kayak 10. As it will be appreciated, the base and the hook portions 326*a*-326*d*, 328*a*-328*d* of the snapfits 324*a*-324*d* are sized to correspond to the distance between the abutment wall 150 of the fifth section 110 and the top face of the lip 138. Provided at the base of each snapfit 324*a*-324*d* is a draining hole 330*a*-330*d* for allowing water to evacuate the interface 300 (best shown in FIG. 16A).

Figure 16A:
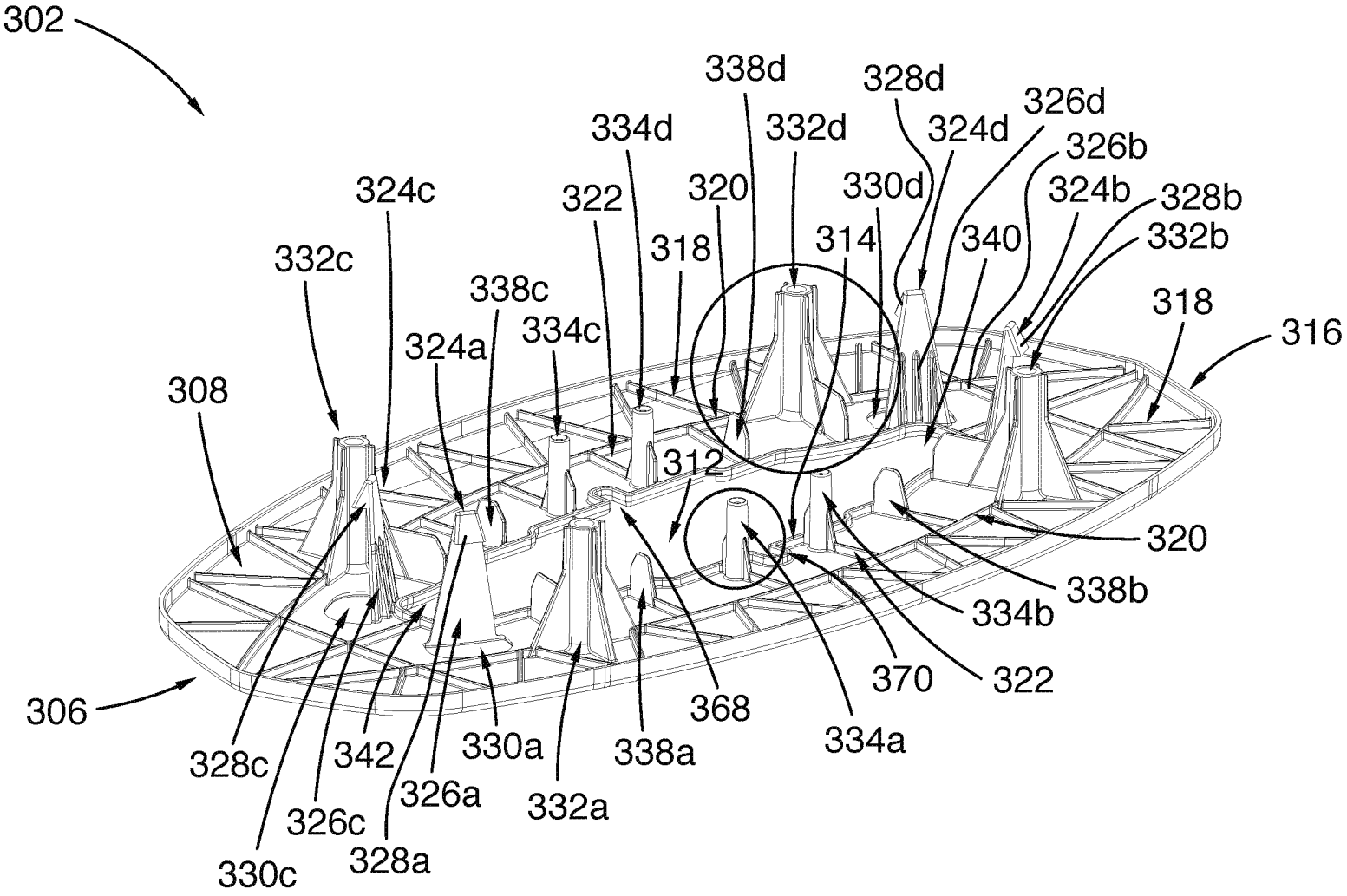
FIG. 16A is a bottom, rear right perspective view of a bottom portion of the interface shown in FIG. 13, in accordance with one embodiment.
Figure 16B:
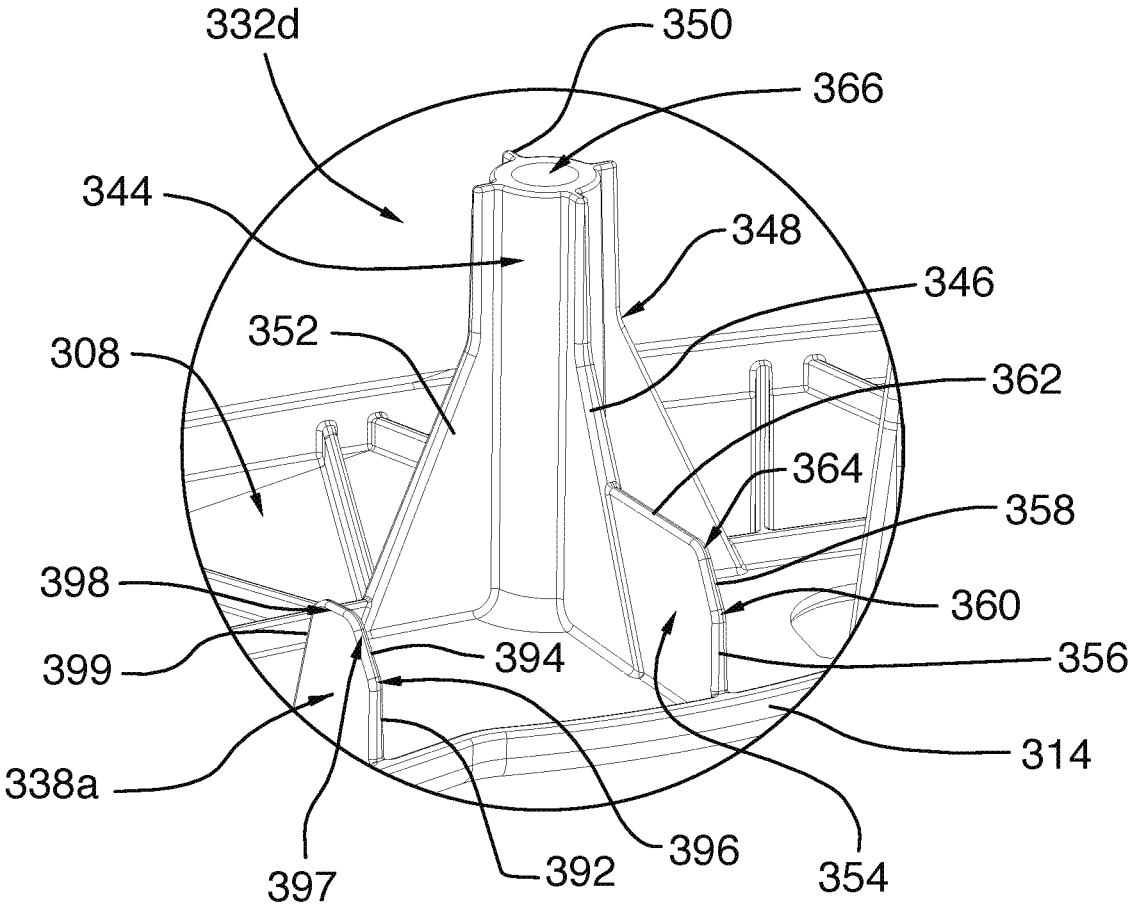
FIG. 16B is a partial, enlarged view of the bottom portion of the interface shown in FIG. 16A, for better showing a fastening projection.

Also extending upwardly from the top face 308 of the bottom plate 306 are a plurality of fastening projections 332*a*-332*d*, a plurality of female portions 334*a*-334*d* of a guide assembly 336, as well as a plurality of guiding fins 338*a*-338*d*. The fastening projections 332*a*-332*d* are located proximal to front and rear ends 340, 342 of the hole 312, generally halfway between the inner and outer peripheral wall 314, 316. With reference to FIG. 16B, each fastening projection 332*a*-332*d* comprises a cylindrical body 344 extending vertically, and a plurality of generally triangular reinforcement members 346, 348, 350 and 352 extending radially from the cylindrical body 344 (only fastening projection 332*d* being illustrated in FIG. 16B). Each fastening projection 332*a*-332*d* also includes a fin 354 extending from one of the triangular reinforcement member 346 toward the inner peripheral wall 314. Each fin 354 comprises a vertical edge 356, extending generally vertical in a location slightly remote from the inner peripheral wall 314 of the bottom plate 306, an inclined edge 358, extending from a top end 360 of the vertical edge 356, and a top edge 362 extending from a top end 364 of the inclined edge 358 toward the cylindrical body 344. Defined in the cylindrical body 344 is a threaded bore 366, for receiving therein a corresponding threaded fastener 132*a* to secure the bottom and top portions 302, 304 of the interface 300 with the body 12 of the kayak 10, as it will become apparent below.

Figure 16C:
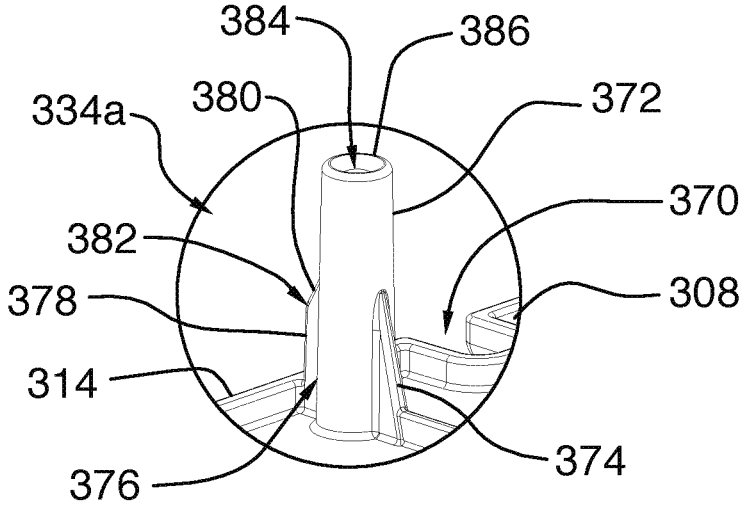
FIG. 16C is another partial, enlarged view of the bottom portion of the interface shown in FIG. 16A, for better showing a female portion of a directing assembly.
Figure 17:
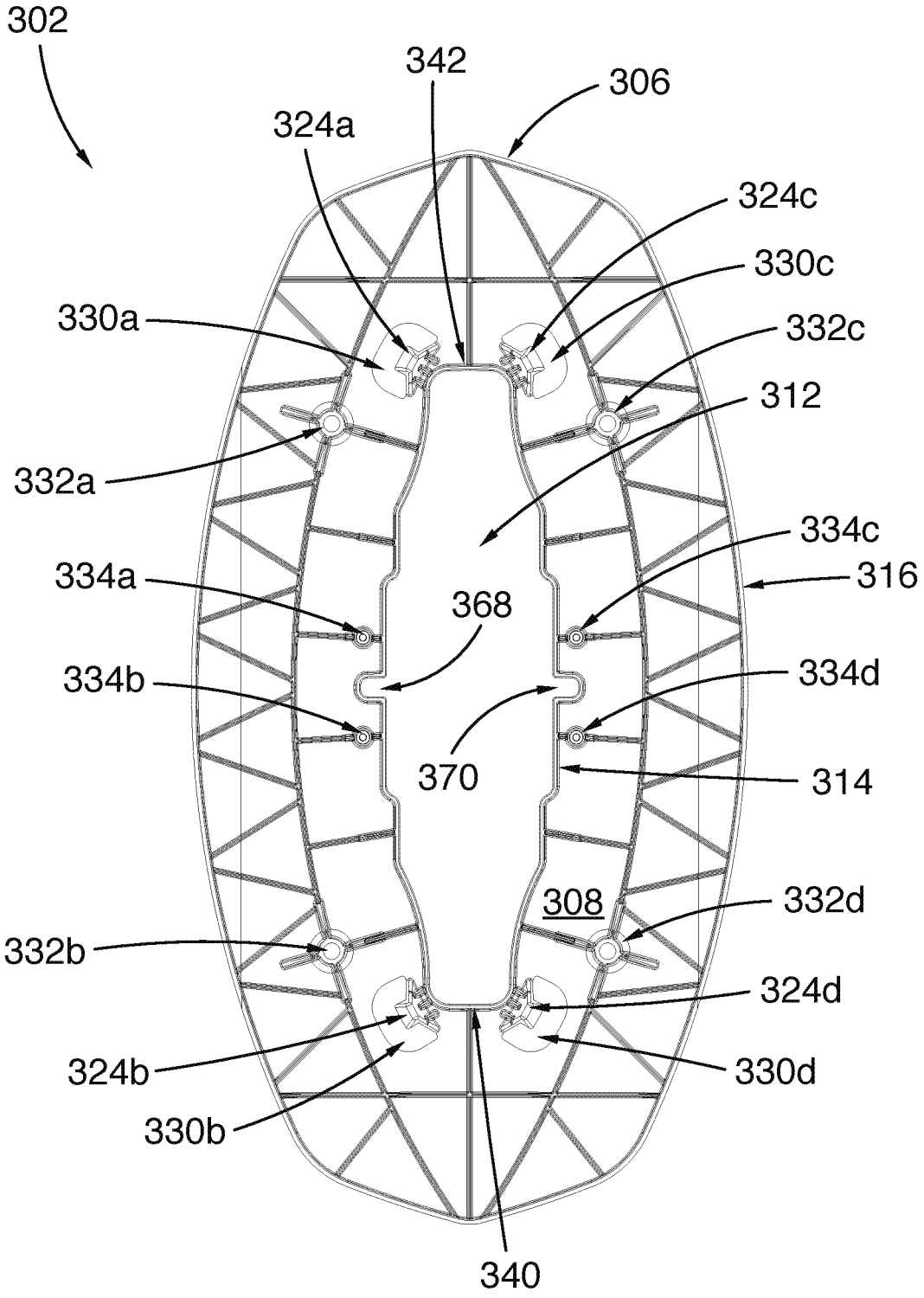
FIG. 17 is a top plan view of the bottom portion shown in FIG. 16A.
Figure 18:
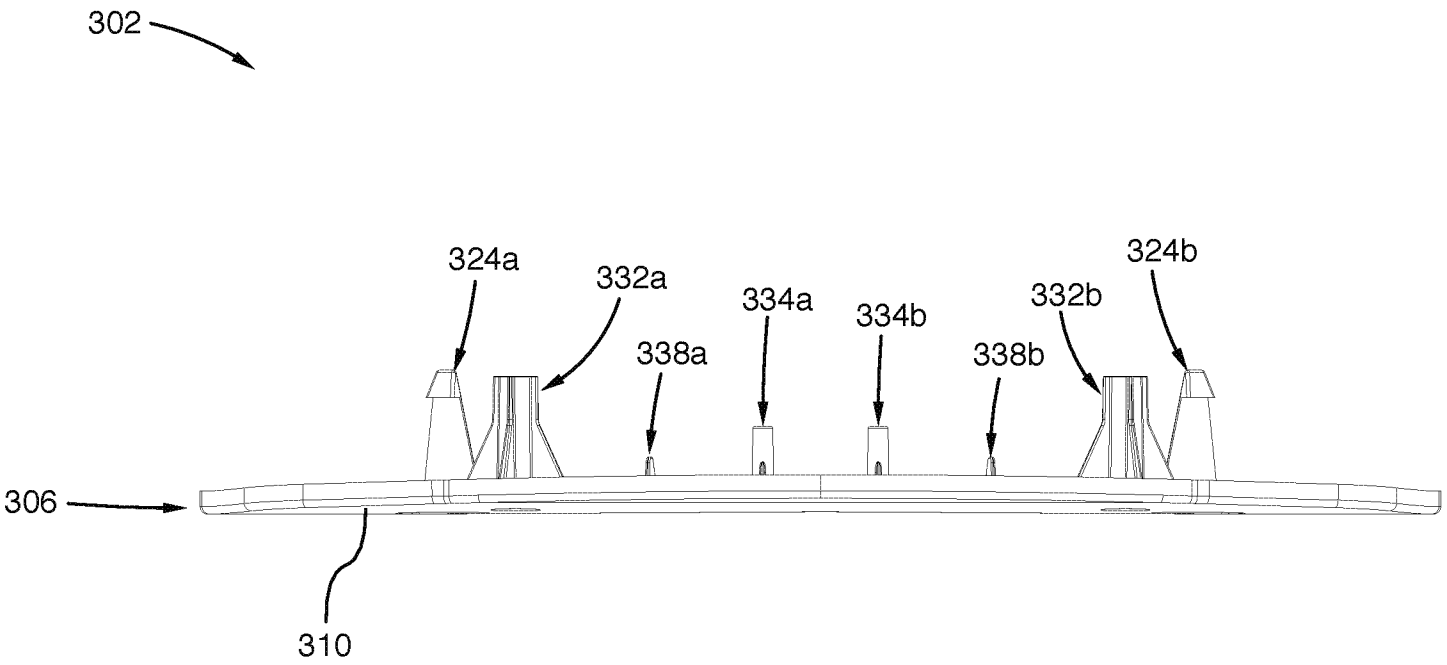
FIG. 18 is a right elevation view of the bottom portion shown in FIG. 16A.
Figure 19:
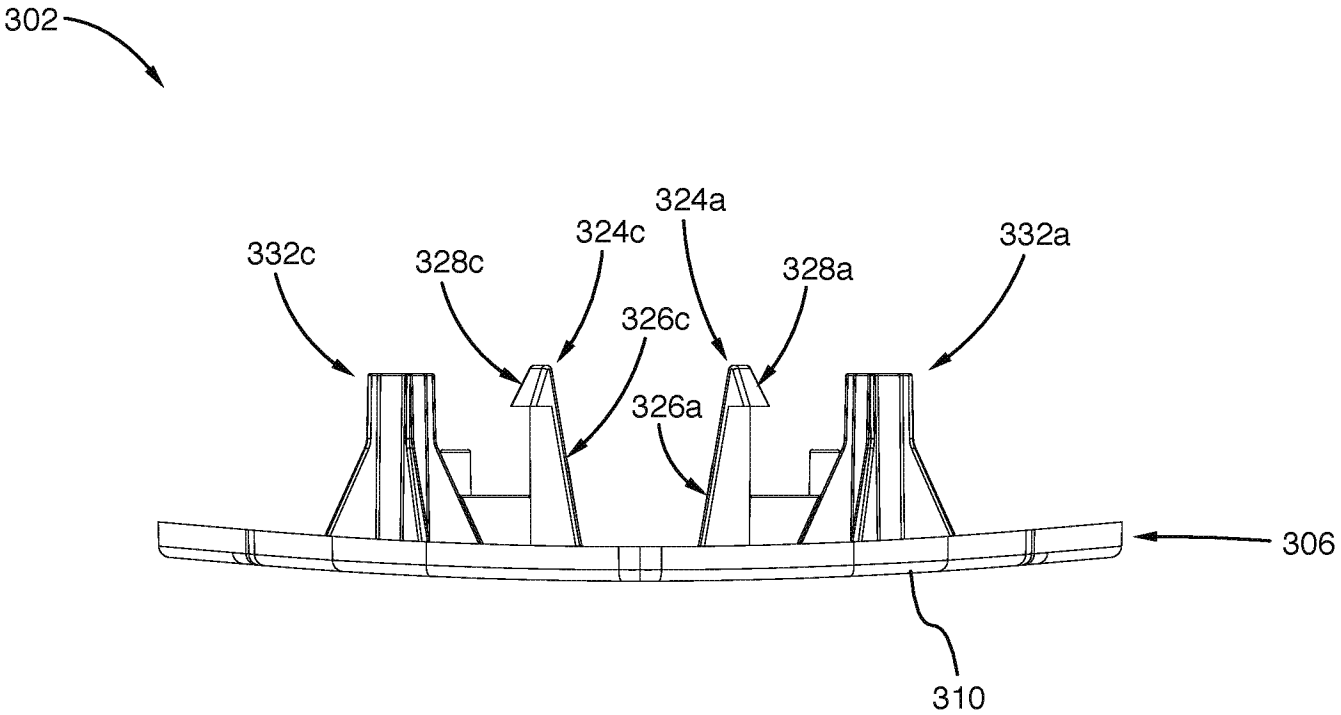
FIG. 19 is a rear elevation view of the bottom portion shown in FIG. 16A.
Figure 20:
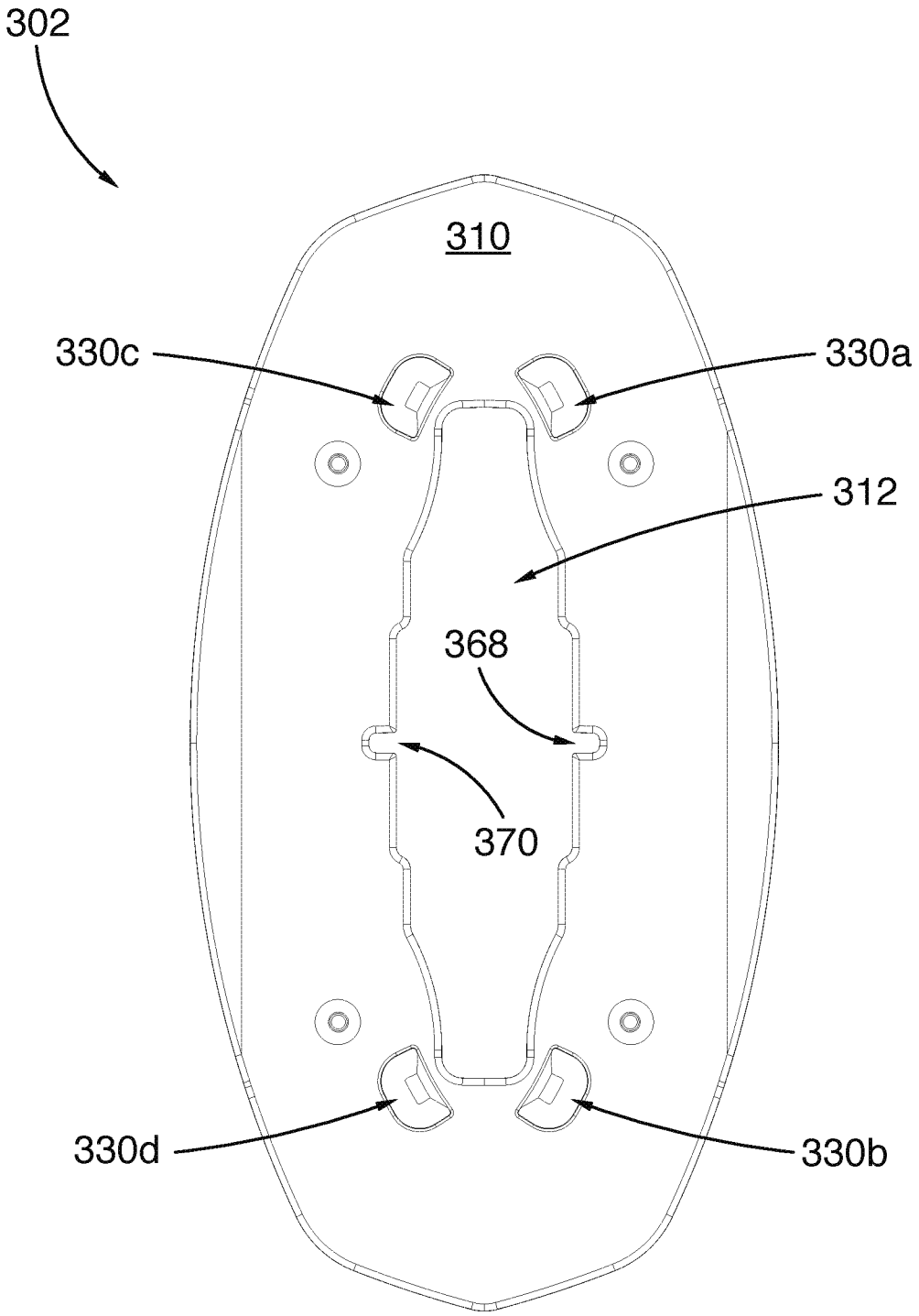
FIG. 20 is a bottom plan view of the bottom portion shown in FIG. 16A.
Figure 21:
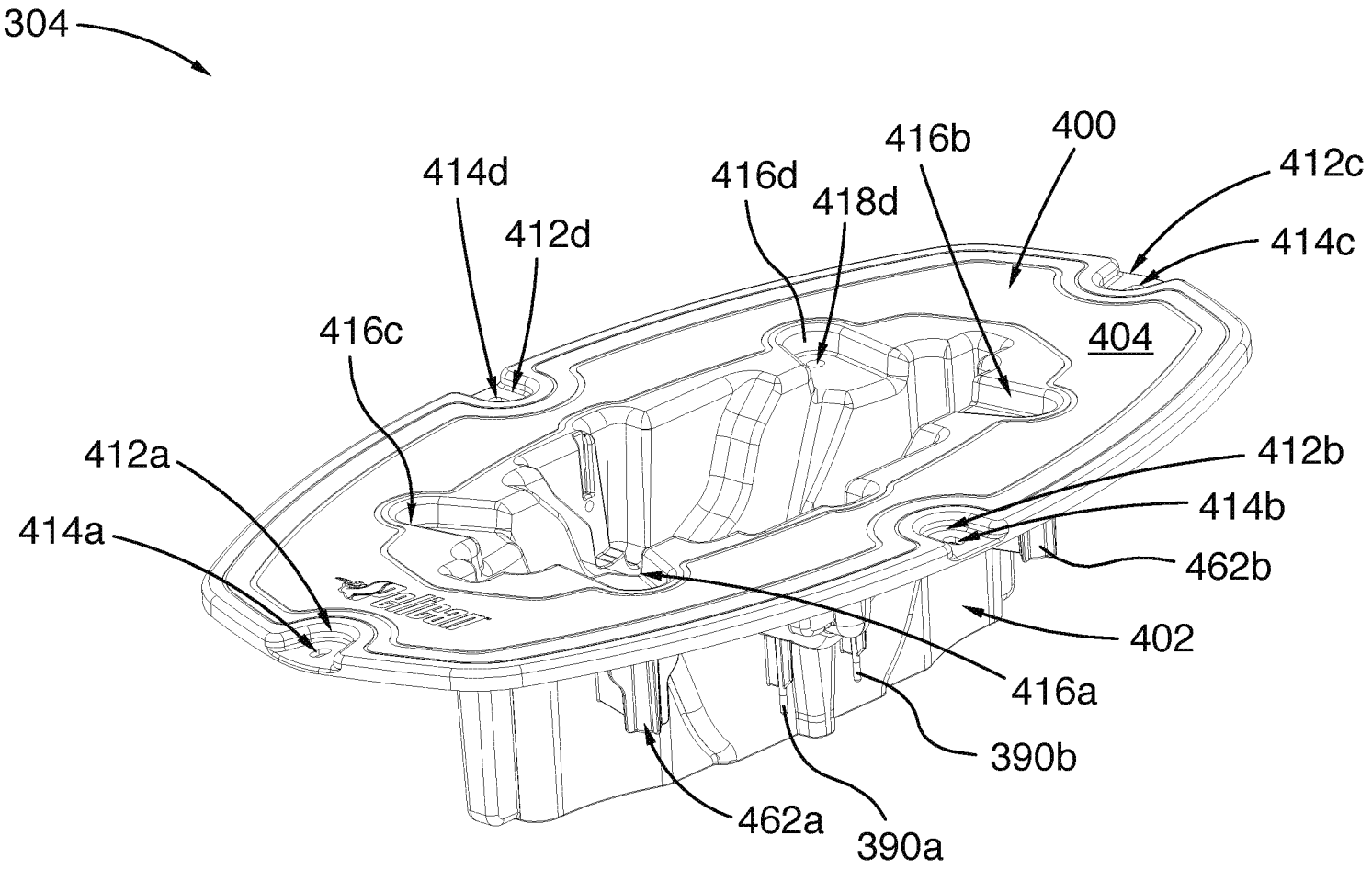
FIG. 21 is a rear, top right perspective view of a top portion of the interface shown in FIG. 13, in accordance with one embodiment.
Figure 22:
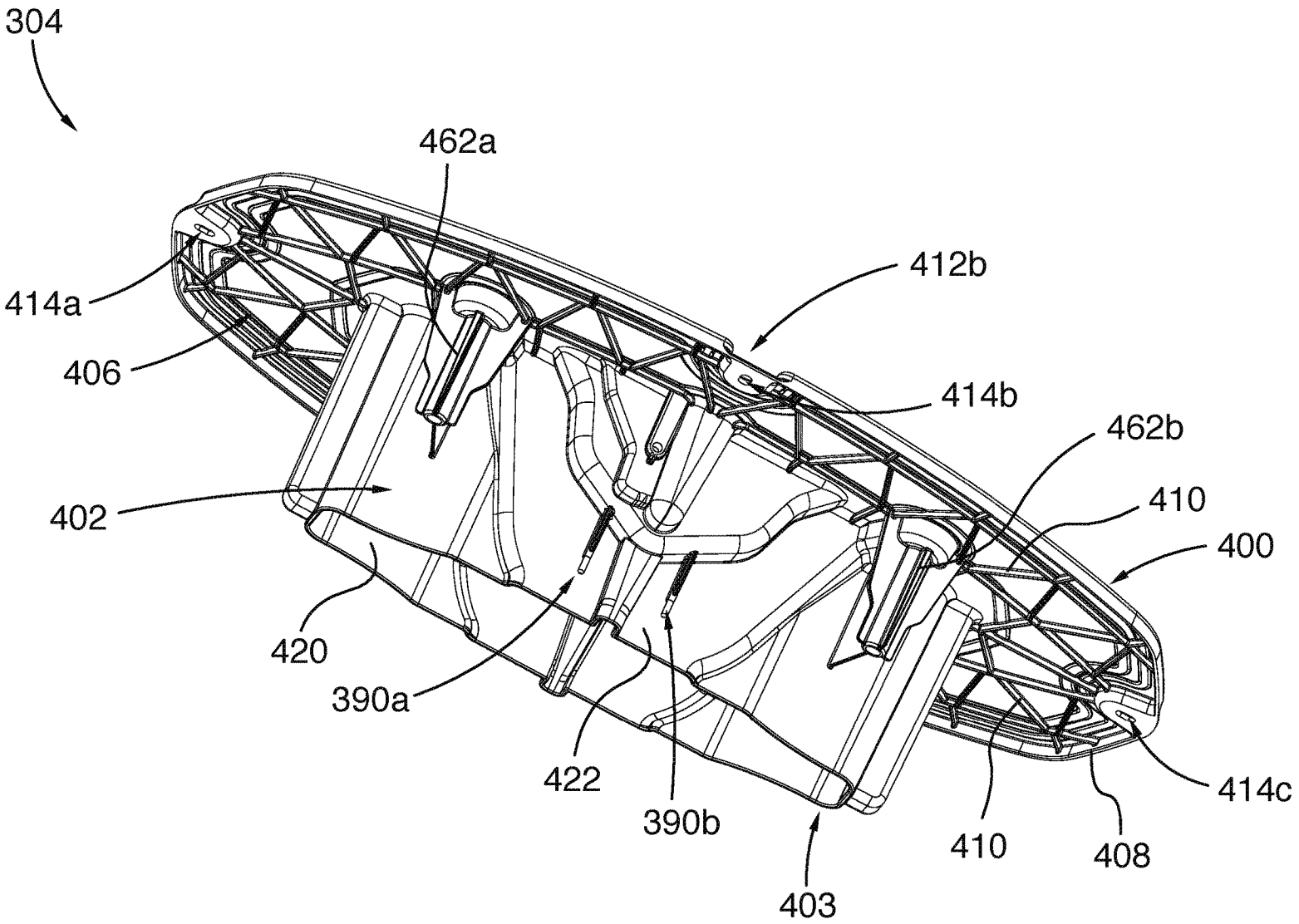
FIG. 22 is a rear, bottom right perspective view of the top portion shown in FIG. 21.
Figure 23:
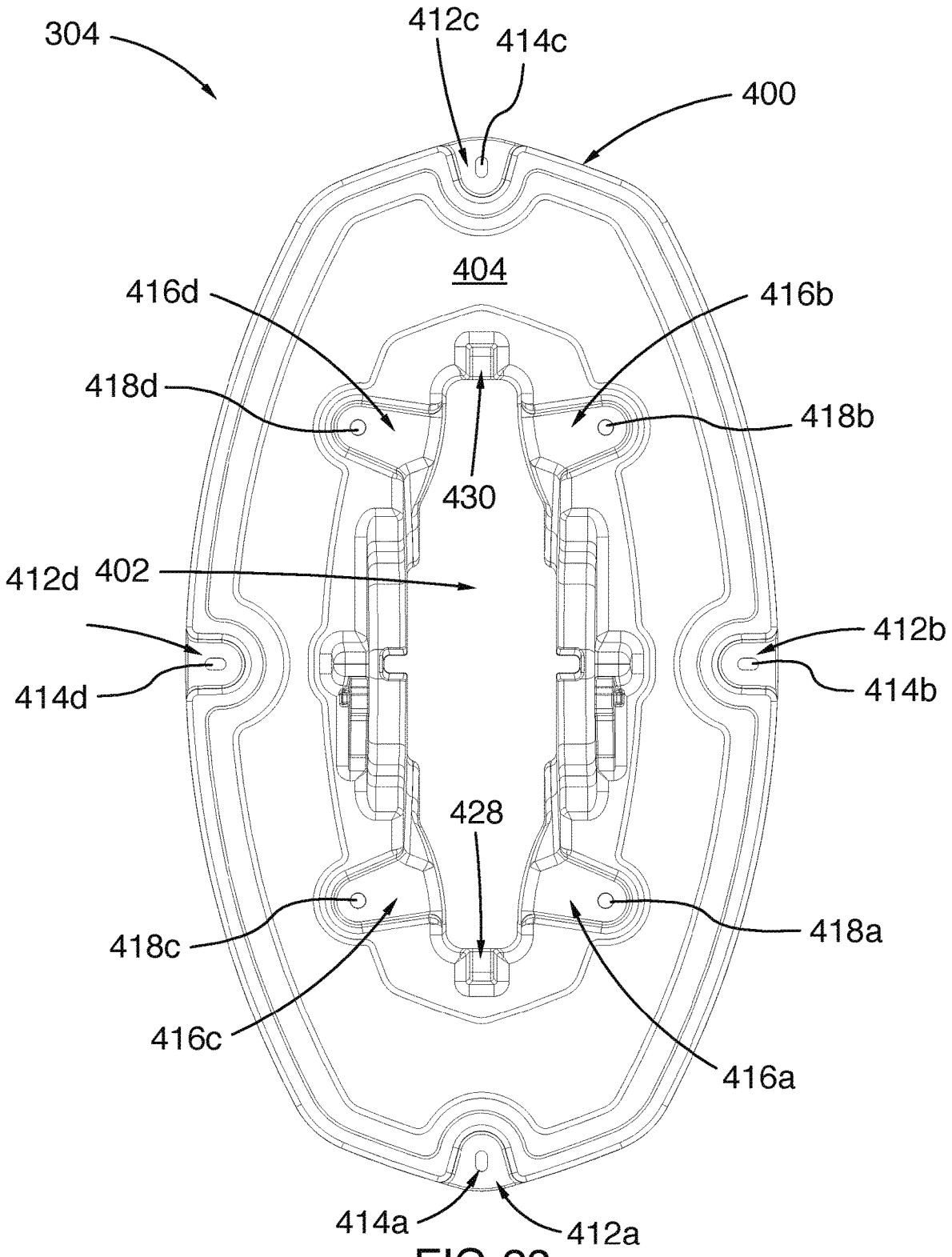
FIG. 23 is a to plan view of the top portion shown in FIG. 21.
Figure 24:
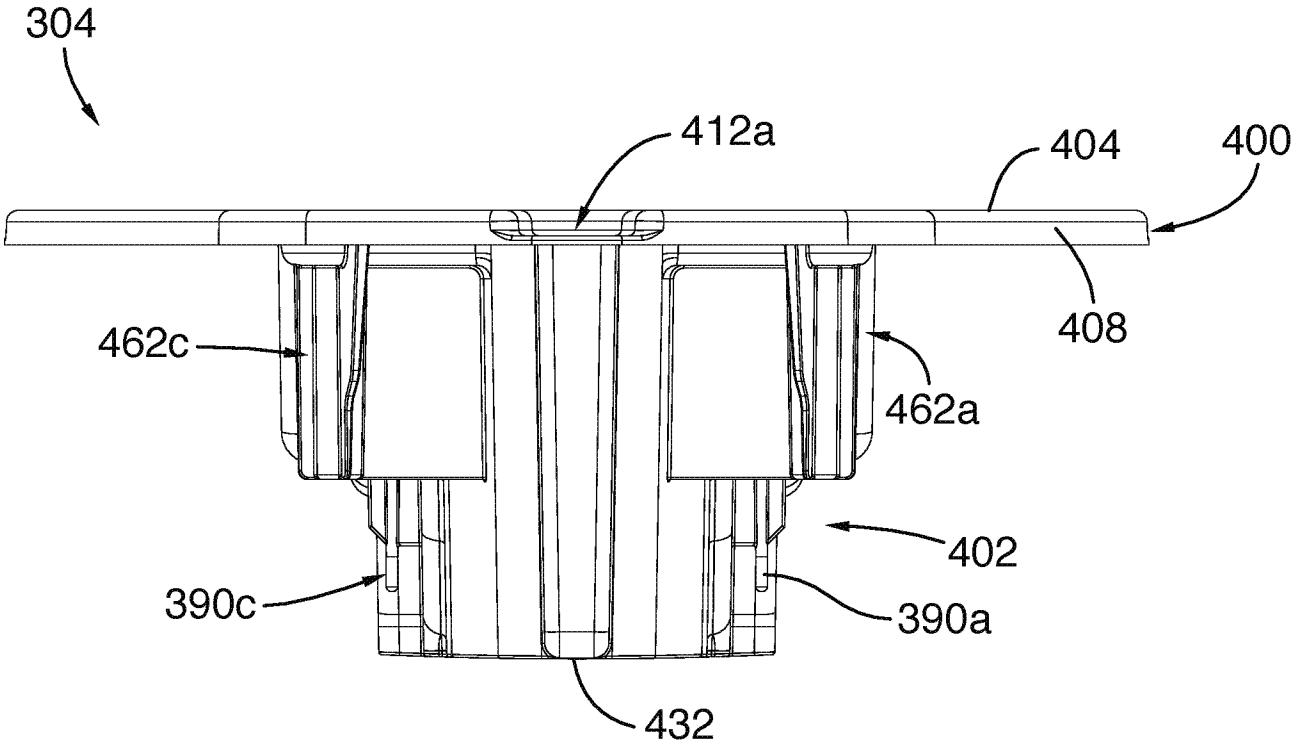
FIG. 24 is a rear elevation view of the top portion shown in FIG. 21.
Figure 25:
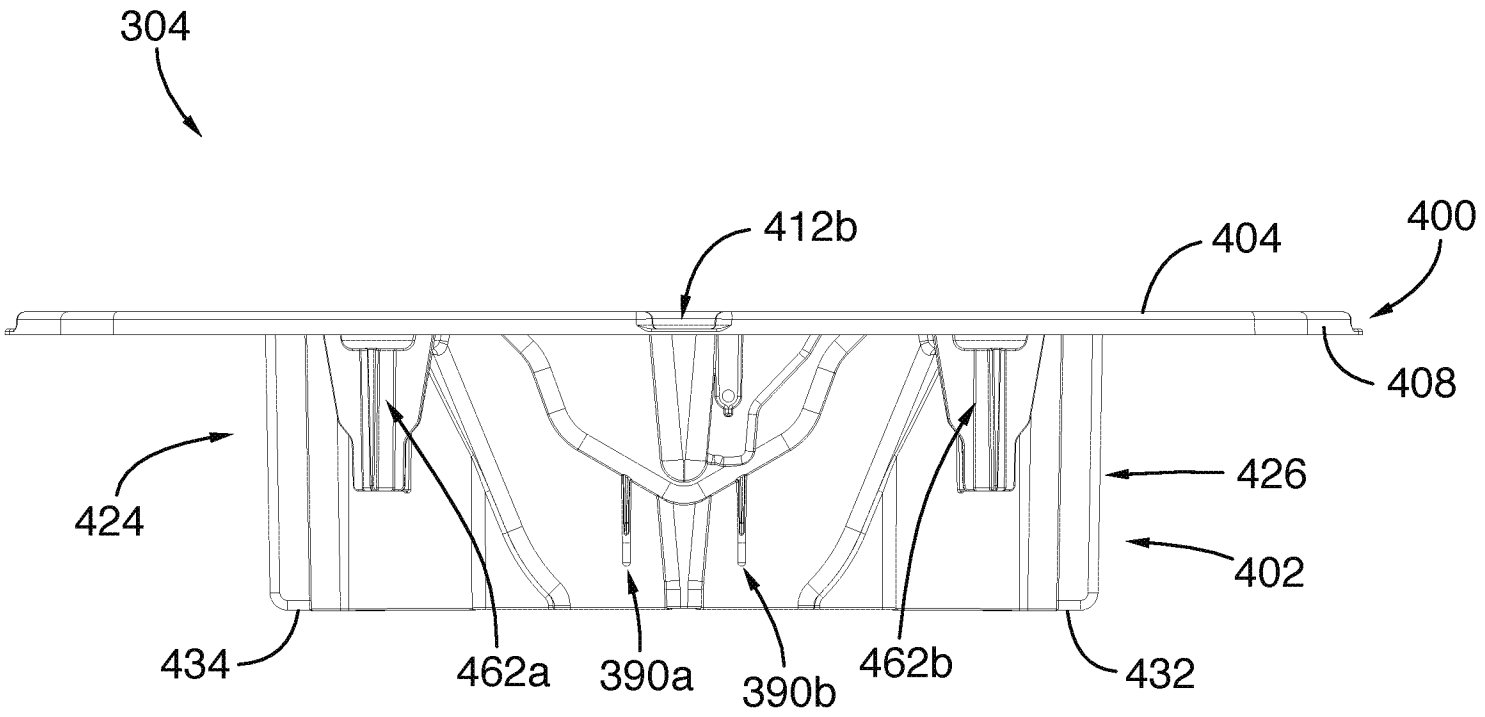
FIG. 25 is a right elevation view of the top portion shown in FIG. 21.
Figure 26:
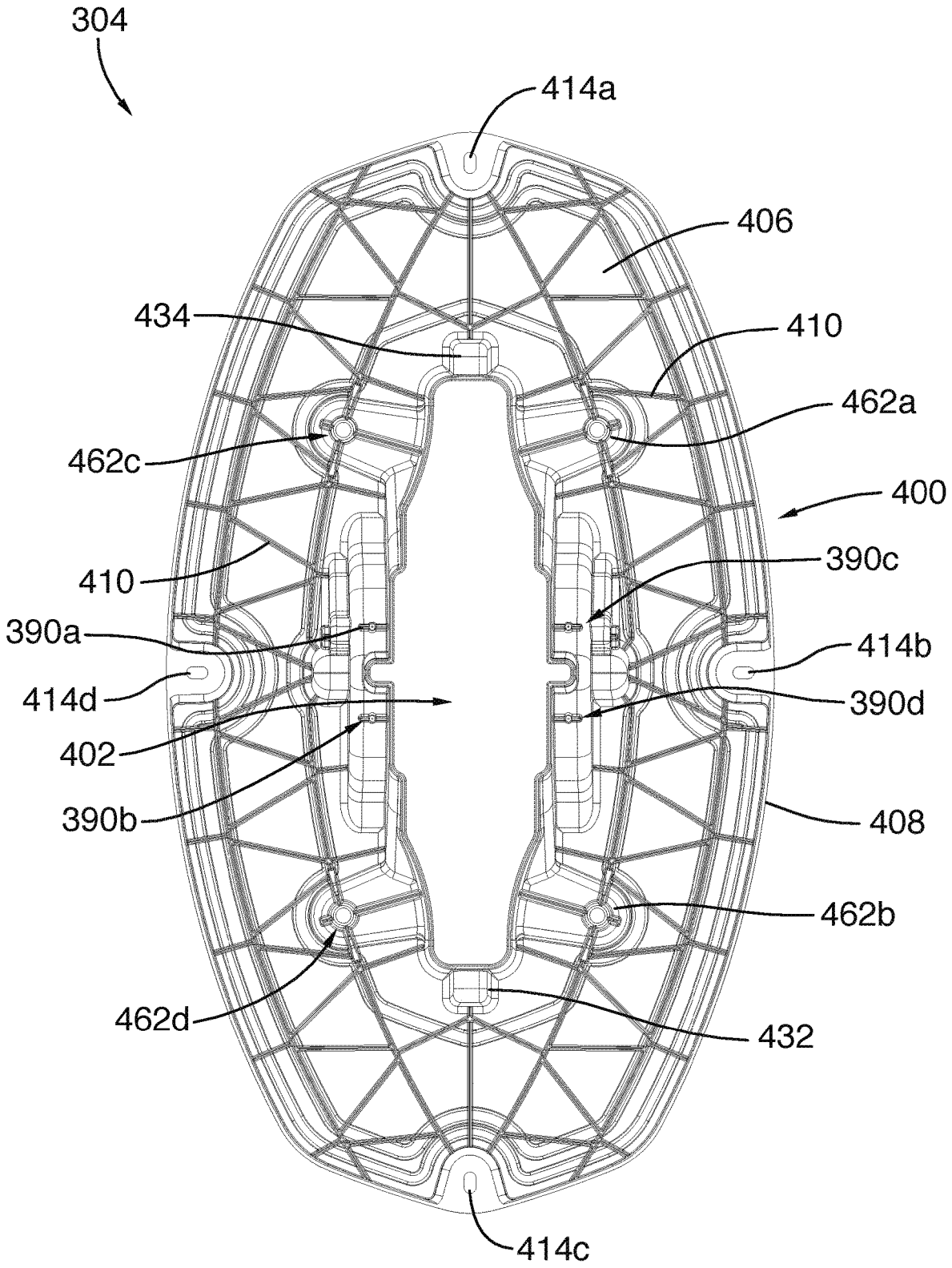
FIG. 26 is a bottom plan view of the top portion shown in FIG. 21.
Figure 27:
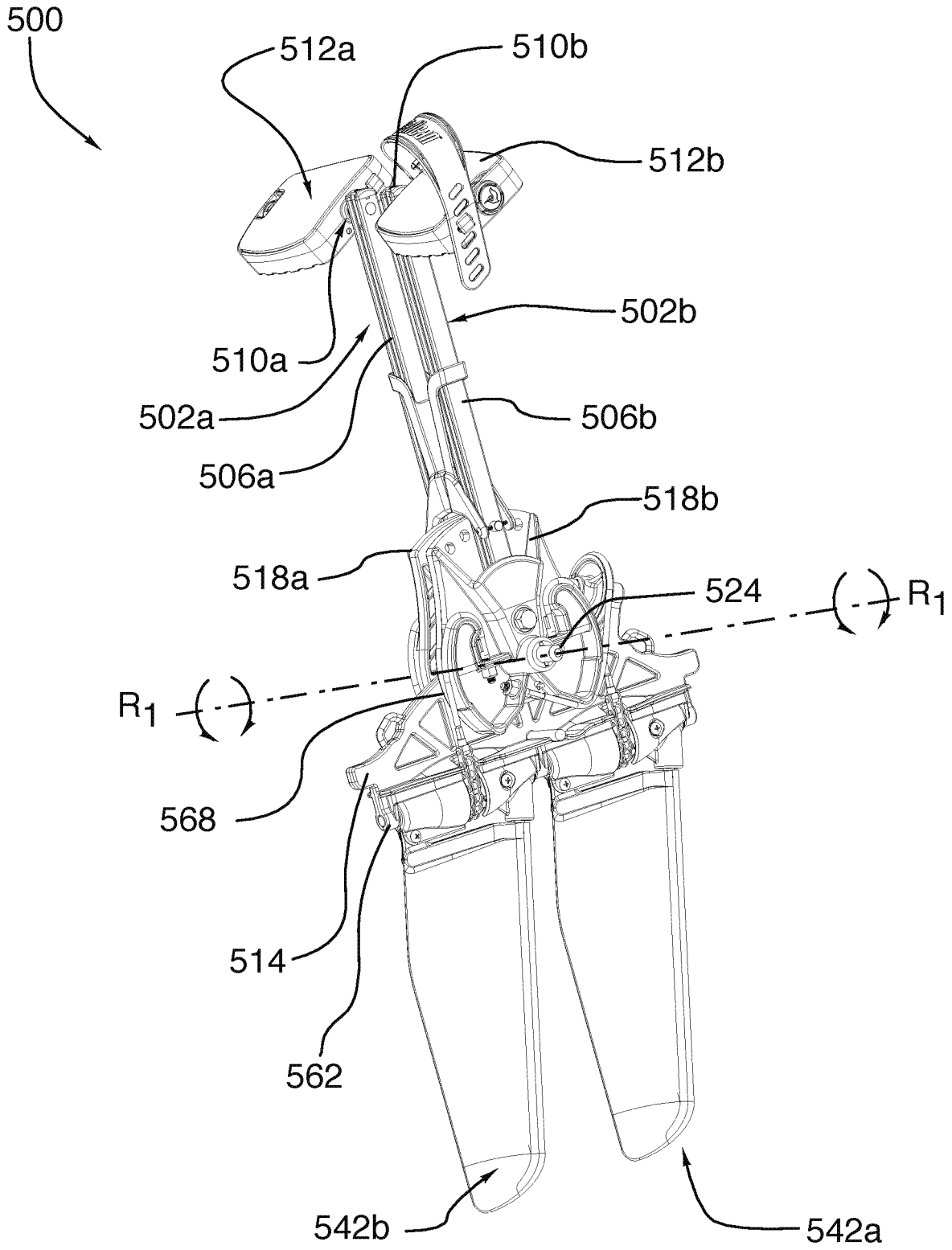
FIG. 27 is a rear, top right perspective view of the propulsion mechanism shown in FIG. 13.
Figure 28:
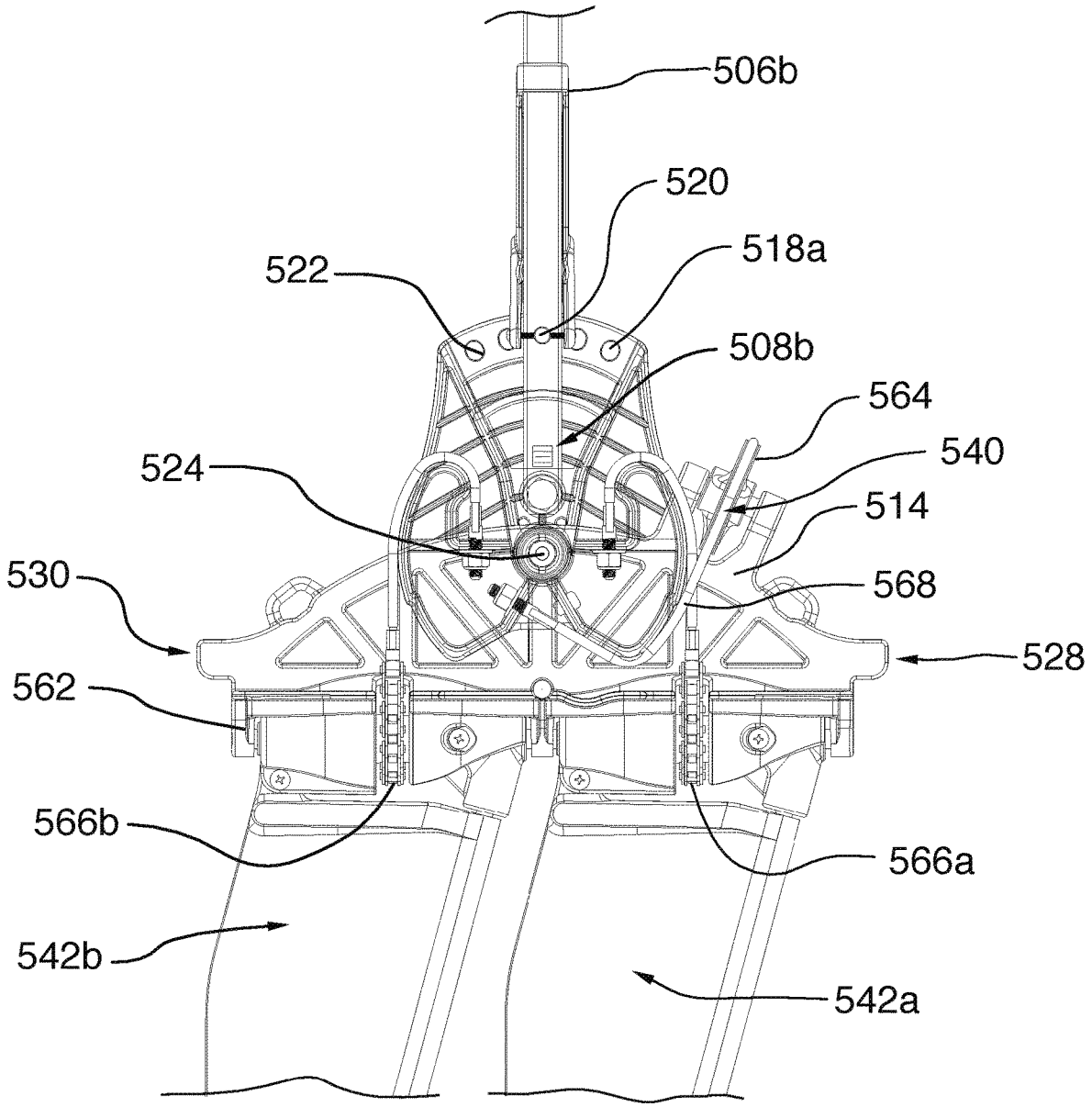
FIG. 28 is an enlarged right elevation view of the propulsion mechanism shown in FIG. 27.

The female portions 334*a*-334*d* of the guide assembly 336 are located adjacent to the elongated hole 312, on the front and rear sides of left and right indentations 368, 370 of the hole 312. With reference to FIG. 16C, each female portion 334*a*-334*d* of the guide assembly 336 comprises a cylindrical body 372, as well as a triangular reinforcement member 374 and a fin 376, the reinforcement member 374 and the fins 376 extending radially from the cylindrical body 372, in opposed directions (only female portion 334*a* being illustrated in FIG. 16C). More specifically, the fin 376 extends between the cylindrical body 372 and the inner wall 314 of the plate 306, while the triangular reinforcement member 374 extends toward the outer peripheral wall 316. Each fin 376 comprises a vertical edge, 378 extending generally vertical in a location slightly remote from the inner peripheral wall 314 of the bottom plate 306, as well as an inclined edge 380, extending from a top end 382 of the vertical edge 378, toward the cylindrical body 372. As such, the inclined edges 380 of the fins 376 are inclined downwardly, toward the elongated hole 312 of the bottom portion 302. Defined in the cylindrical body 372 of each female portion 334*a*-334*d* is a cylindrical hole 384 with a funneled opening 386 for receiving therein a male portion 390*a*-390*d* of the guide assembly 336, as it will be described in greater detail below.

Returning to FIG. 16B, the guiding fins 338*a*-338*d* each comprises a vertical edge 392, extending generally vertical in a location slightly remote from the inner peripheral wall 312 of the bottom plate 306, an inclined edge 394, extending from a top end 396 of the vertical edge 392, a top edge 398 extending from a top end 397 of the inclined edge 394 toward the outer peripheral wall 316, and a rear edge 399, extending from the top edge 398, at a slight angle, and connecting the same to a corresponding ridge 322. As best shown in FIG. 16A, one guiding fin (e.g. 338*a*) is positioned generally halfway between the fin of a fastening portion (e.g. fin 354*a* of fastening portion 332*a*) and the fins of the female portion of the directing assembly 336 (e.g. fin 376 of female portion 334*a*). Together, the guiding fins 334*a*-334*d*, the fins 354 of the fastening portions 332*a*-332*d* and the fins 376 of the female portions 334*a*-334*d* of the directing assembly 336 collaborate to guide the positioning of the top portion 304 of the interface 300 relative to the bottom portion 302 during the assembly of the interface 300, and maintaining such position once the interface 300 is assembled, as it will become apparent below. While in the illustrated embodiment the interface 300 comprises four guiding fins 338*a*-338*d*, four fins 354*a*-354*d* of fastening portions 332*a*-332*d* and four fins 376 of female portions 334*a*-334*d*, it will be appreciated that the interface 300 could comprise a different number of fins, and that the configuration of the fins could vary. For instance, the interface could be provided with only four fins, whether they are found on the fastening portions 332*a*-332*d*, the female portions 334*a*-334*d* or in any other suitable location of the bottom portion 302 of the interface.

With reference to FIGS. 21 to 26, the top portion 304 of the interface 300 will now be described. The top portion 304 comprises a generally horizontal top plate 400 as well as a channel portion 402 extending downwardly from the top plate 400, for receiving and mounting therein the foot propulsion mechanism 500.

The top plate 400 comprises a top face 404 and a bottom face 406, and is sized and shaped to be received in the recess 116 defined by the first portion 102 of the oblong well 100 defined in the body 12 of the kayak 10. Extending downwardly from the bottom face 406 of the top plate 400, about it periphery, is an outer peripheral wall 408. Also extending downwardly from the bottom face 406, between the peripheral wall 408 and the channel 402, are a plurality of reinforcement ridges 410. Together with the outer peripheral wall 408 of the top plate 400, the reinforcement ridges 410 contribute to provide the top plate 400 with additional rigidity in torsion and/or bending.

Defined on the top face 404 of the top plate 400, about the periphery, are four peripheral recesses 412*a*-412*d* each comprising an oblong hole 414*a*-414*d*. The oblong holes 414*a*-414*d* and the recesses 412*a*-412*d* are configured for receiving therein the threaded fasteners 120*a*-120*d* to fasten the top portion 304 of the interface 300 to the body 12 of the kayak 10, and accommodating the head of such fasteners 120*a*-120*d* when the interface 300 is properly fastened to the body 12. Also defined on the top face 404 are four recesses 416*a*-416*d*, which are positioned adjacent to the channel portion 402. Each recess 416*a*-416*d* is provided with a corresponding hole 418*a*-418*d*. As it will become apparent below, the holes 418*a*-418*d* are configured for allowing the passage of the threaded fasteners 132*a*-132*d* used to secure the top portion 304 of the interface 300 to the bottom portion 302 while the recesses 416*a*-416*d* are configured for accommodation the head of fasteners 132*a*-132*d* when such bottom and top portion 302, 304 are secured together to the body 12 of the kayak 10.

The channel 402 of the top portion 304 comprises an inner face 420 and an outer face 422, and a bottom end 403. At front and rear ends 424, 426 thereof, the channel 402 is provided with front and rear slots 428, 430 sized and shaped for respectively receiving front and rear ends 550, 552 of a core support 514 of the foot propulsion mechanism 500. At the bottom of the front and rear slots 428, 430 are abutments 432, 434, on which resting surfaces 554, 556 of the front and rear ends 550,552 of the core support 514 rest when the propulsion mechanism 500 is properly mounted to the interface 300.

Figure 14:
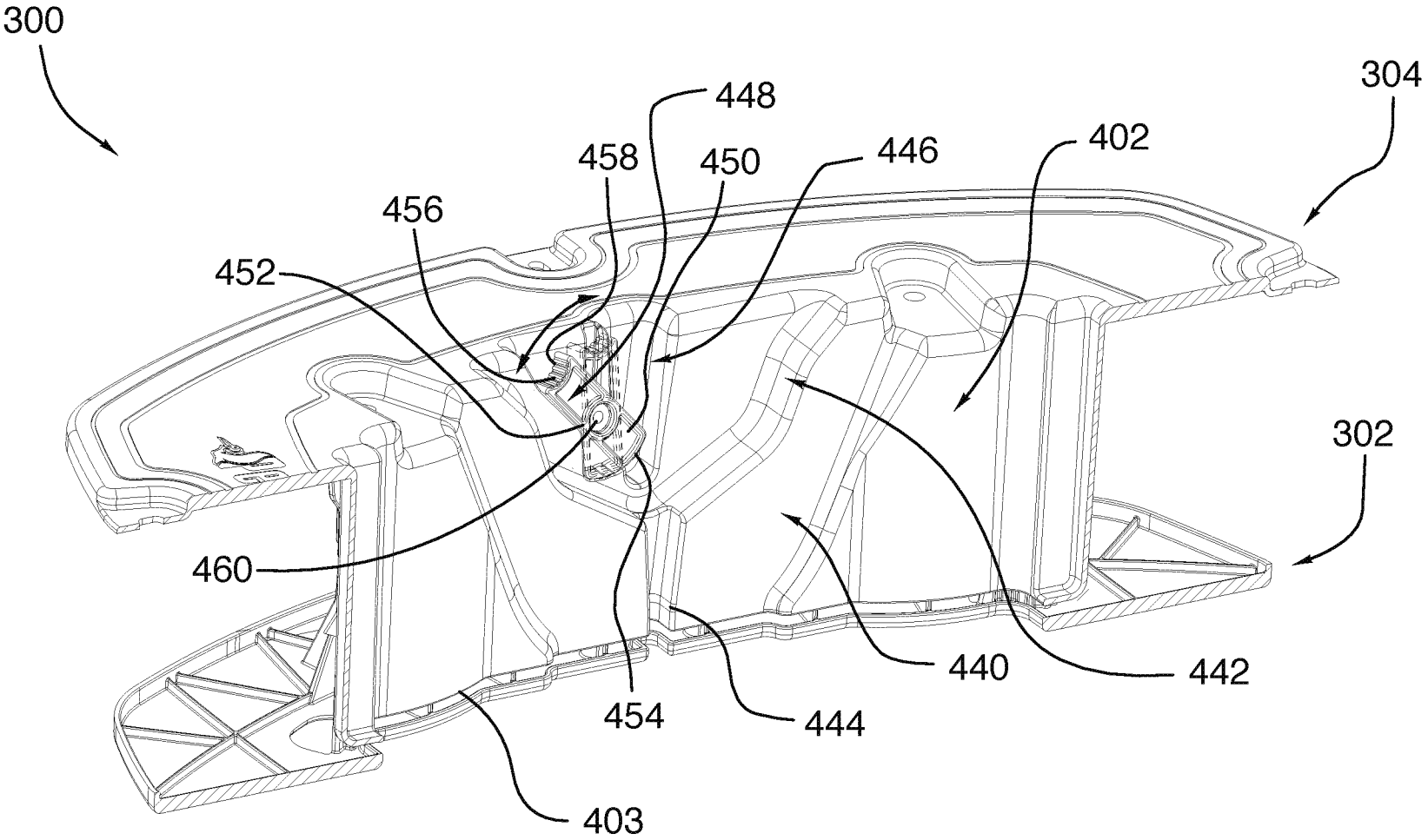
FIG. 14 is a cross-sectioned perspective view of the interface shown in FIG. 13, taken along line XIV-XIV.
Figure 15:
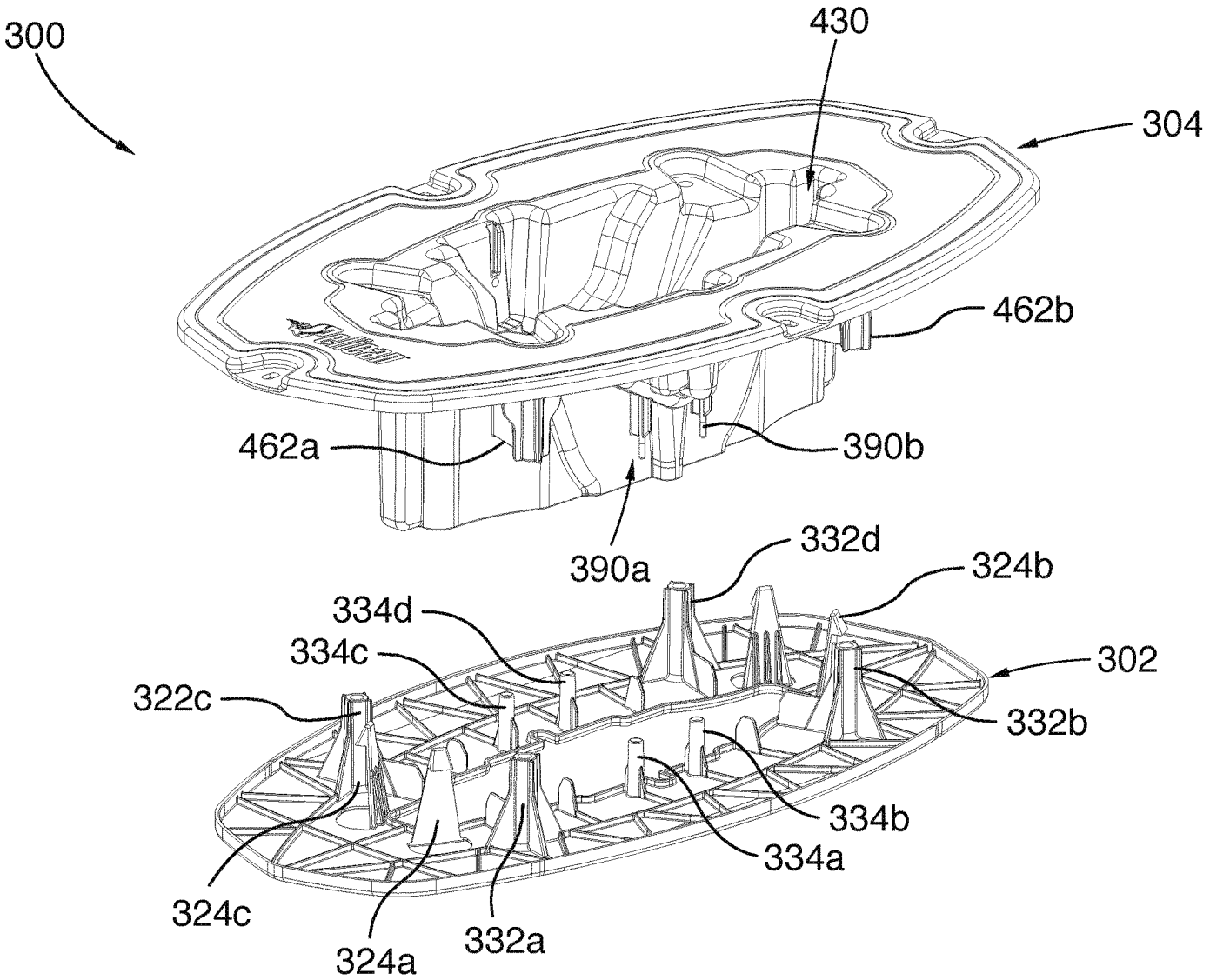
FIG. 15 is an exploded view of the interface shown in FIG. 13.

With reference to FIG. 14, the channel 402 also comprises a first V-shaped recess 440, a second V-shaped recess 442 terminating into a lower funnel-shape slot 444, as well as a top funnel slot 446 and a lock receiving recess 448. At the bottom end 403 of the channel 402, the first V-shaped recess 440 and the remainder of the channel 402 are sized and shaped to generally conform to the periphery of the core support 514 of the foot propulsion mechanism 500, while the lower funnel-shaped slot 444 is configured to receive left and right transverse projections 548*a*, 548*b* of the core support 514, as it will be described in greater details below.

The top funnel slot 446 is configured for receiving therein a mounting shaft 524 of the foot propulsion mechanism 500. Mounted in each of the lock receiving recesses 448 is a lock 450. In the illustrated embodiment, the lock 450 comprises a generally elongated flat member 452 including a convex lower end 454 and a concave upper end 456, the concave upper end 456 being provided with grip elements 458 for enhancing contact between a finger of a user and the lock 450 for releasing the foot propulsion mechanism 500 from the interface 300. Provided in an intermediate location between the upper end 456 and the lower end 454 is a hole (not shown) for receiving a fastener 460 for pivotably mounting the lock 450 in the lock receiving recess 448 of the channel 402. When properly assembled, the lock 450 is pivotable between an unlock position for allowing the passage of the shaft (shown in dotted line in FIG. 14) and a lock position for preventing the passage of the mounting shaft 524 of the foot propulsion mechanism (shown in continuous line in FIG. 14) to thereby prevent unwanted removal of the foot propulsion mechanism 500 from the interface 300. In one embodiment, the lock 450 is provided with a bias mechanism (not shown), for instance a coil spring or a torsion spring, to bias the lock 450 toward the lock position.

Returning to FIGS. 22 to 25, extending downwardly from the bottom face 406 of the top plate 400 are fastening projections 462*a*-462, as well the male portions 390*a*-390*d* of the directing assembly 336. Each fastening projection comprises a generally cylindrical body 466*a*-466*d* provided and a plurality of reinforcement members 468*a*-468*d*, 470*a*-470*d*, 472*a*-472*d* and 474*a*-474*d*. Defined in the cylindrical body 466*a*-466*d* are holes 418*a*-418*d*.

While in the above embodiment the guiding assembly (i.e. the guiding fins 334*a*-334*d*, the fins 354 of the fastening portions 332*a*-332*d* and the fins 376 of the female portions 334*a*-334*d* of the directing assembly 336) are provided on the bottom plate 302 of the interface 300, and the channel 402 is provided on the top portion 304 of the interface, it will be understood that the location of these components could be inverted, where the channel (e.g. channel 402) would be provided on the bottom portion 302 and the guiding assembly would be provided on the top portion 304 of the interface.

Turning now to FIGS. 27 to 30, the foot propulsion mechanism 500 will now be described. In the illustrated embodiment, the foot propulsion mechanism 500 is an oscillating flapper propulsion system and comprises a set of left and right pedals 502*a* and 502*b* extending upwardly from the top portion 304 of the interface 300 when the foot propulsion mechanism 500 is properly mounted thereto. The pedals 502*a*, 502*b* are operatively mounted to a pair of oscillating, flexible flappers 542*a*, 542*b* via a cable and chain transmission 540 supported on a core support 514.

More specifically, the pedals 502*a*, 502*b* are adapted to be alternatively pushed by the user's feet to actuate the foot propulsion mechanism 500. Each of the left and right pedals 502*a*, 502*b* comprises a shaft 506*a*, 506*b* including a lower end 508*a*, 508*b* and an upper end 510*a*, 510*b*, as well as a footrest 512*a*, 512*b* for receiving one corresponding foot a the user. The lower ends 508*a*,508*b* of the shafts 506*a*, 506*b* are mounted to the core support 514, which is configured to extend longitudinally (i.e. along the longitudinal axis $L_1$-$L_1$ of the kayak 10 when the propulsion mechanism 500 is mounted to the interface 300), via a pair of mounting brackets 518*a*, 518*b*. Each mounting bracket 518*a*, 518*b* allow adjustment of the distance between the footrests 512*a*, 512*b* and the seat 28 by way of an adjustment bolt 520 engaging the lower ends 508*a*, 508*b* of the shafts 506*a*, 506*b* and a plurality of adjustment holes 522 disposed on the mounting brackets 518*a*, 518*b*. The mounting brackets 518*a*, 518*b* are also configured for receiving a mounting shaft 524 extending transverse to the longitudinal axis $L_1$-$L_1$ and engaging the core support 514. The mounting shaft 524 allow rotation of the left and right pedals 502*a*,502*b* relative to the core support 514, about a rotation axis $R_1$-$R_1$.

Figure 29:
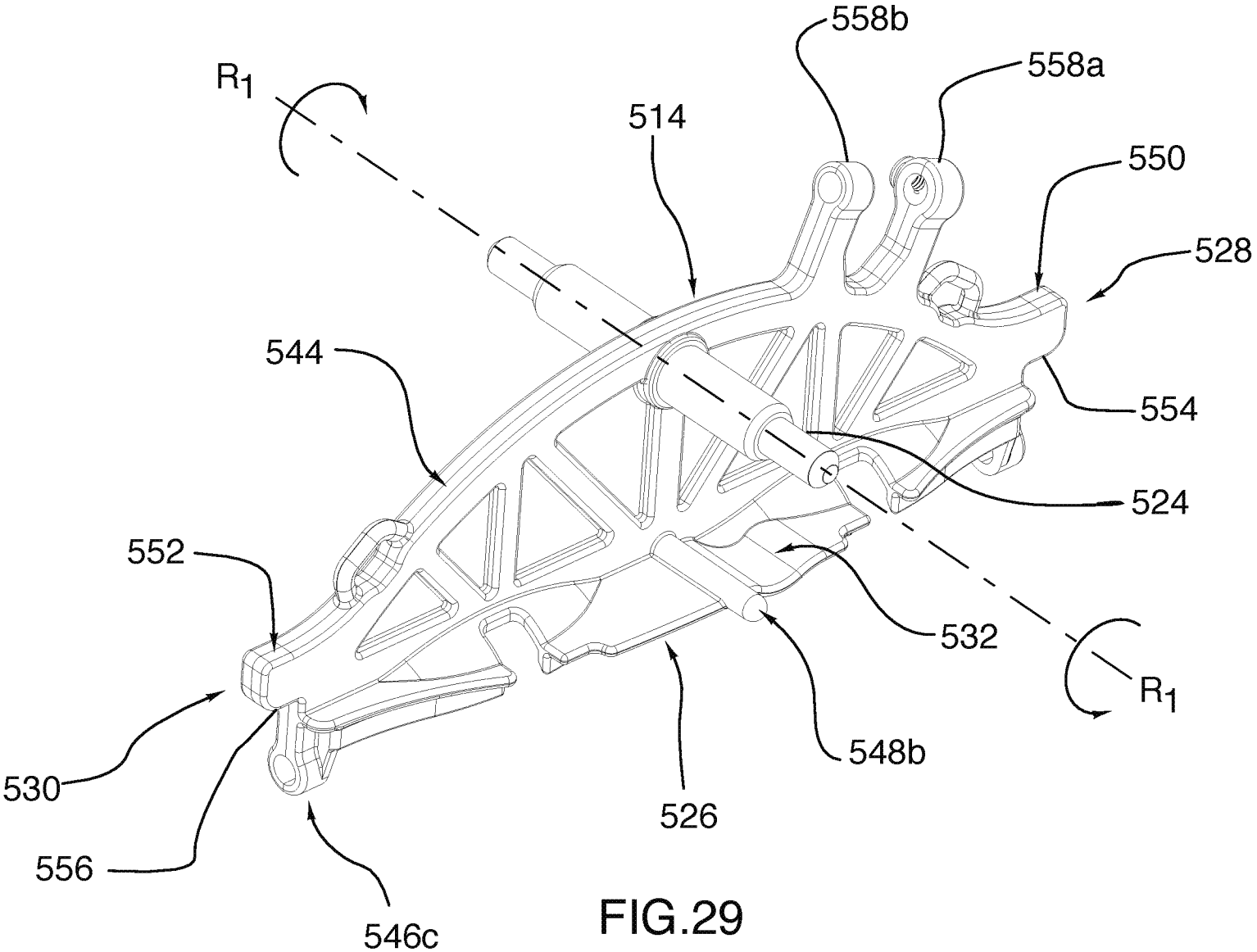
FIG. 29 is a rear, top right perspective view of a core support of the propulsion mechanism shown in FIG. 27, with a pedal shaft mounted thereto.
Figure 30:
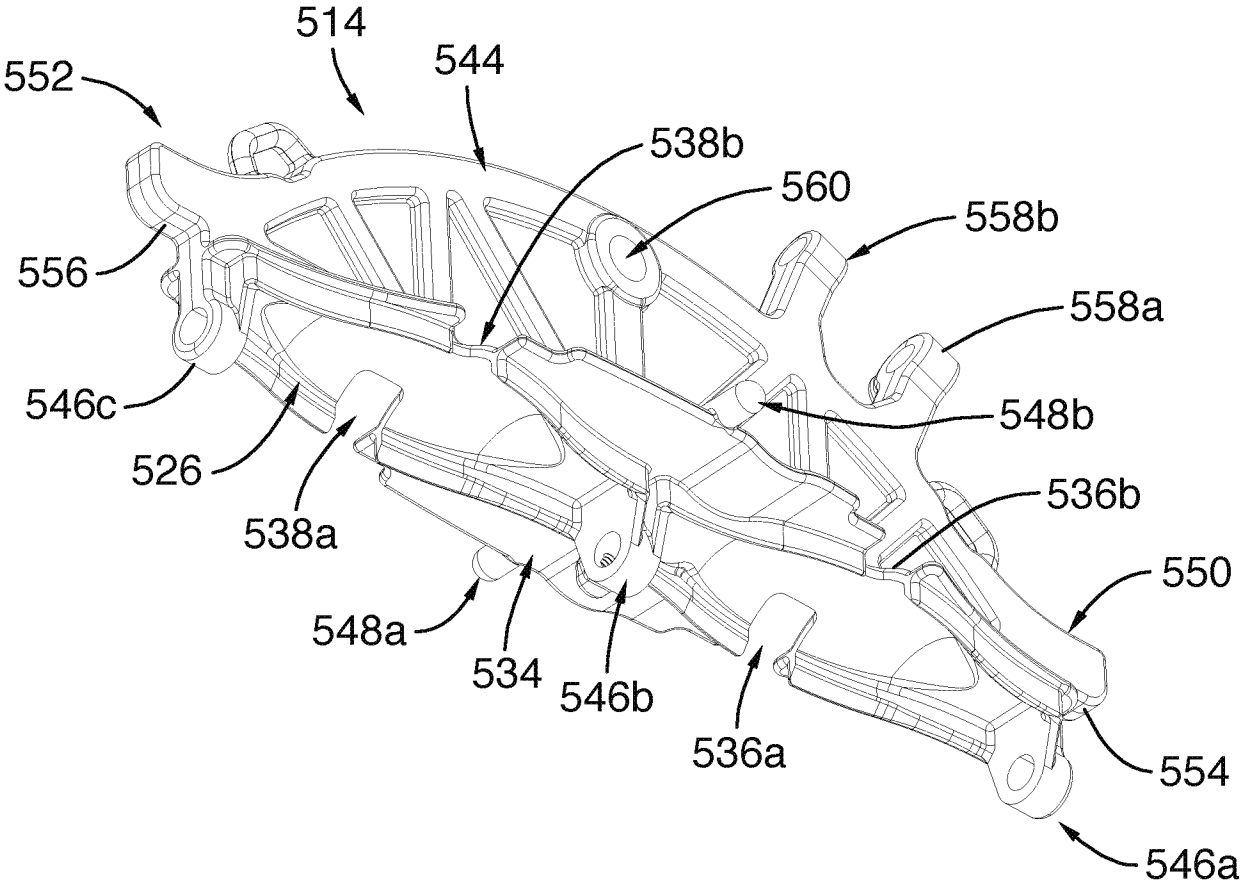
FIG. 30 is a rear, bottom right perspective view of the core support shown in FIG. 29, without the pedal shaft.

With reference to FIGS. 29 and 30, the core support 514 is a monolithic piece and comprises a generally horizontal base 526 having a front end 528, a rear end 530, a top face 532 and a bottom face 534. The generally horizontal base 526 is sized and shaped to be received in the channel 402 of the interface 300 and to substantially conceal the same when the foot propulsion mechanism 500 is mounted to the interface 300, and comprises a plurality of indentations 536*a*, 536*b* 538*a*, 538*b* for allowing the passage of the cable and chain transmission 540 operatively coupling the pedals 502*a*, 502*b* to the flappers 542*a*, 542*b*. The core support 514 also comprise an upright mounting support 544 extending upwardly from the top face 532 of the base 526, as well as three mounting brackets 546*a*-546*c* extending downwardly from the bottom face 534 for mounting the flappers 542*a*, 542*b*. At the junction of the horizontal base 526 and the upright support 544, generally halfway between the front and rear ends 528, 530, are left and right transverse projections 548*a*, 548*b*, which protrude on each side of the base 526. As is will be described in greater details below, the left and right transverse projections 548*a*, 548*b* are sized and shaped to engage the lower funnel-shaped slot 444 of the interface 300.

The upright mounting support 544 comprises a front end 550 and a rear end 552. The front and rear ends 550, 552 of the upright mounding support 514 extend beyond the front and back ends 528, 530 of the horizontal base 526, to define restring surfaces 554, 556 for mounting the foot propulsion mechanism 500 to the interface 300, as it will become apparent below. The upright support 544 also comprises a pair of pulley mounting brackets 558*a*, 558*b* as well as a transverse bore 560 for receiving therein the mounting shaft 524. To mount the pedals 502*a*,502*b* to the core support 514, the shaft 524 is rotatably engaged in the mounting brackets 518*a*, 518*b* of the pedals 502*a*, 502*b* and the transverse hole 560 of the upright mounting support 544. When properly positioned, the mounting shaft 524 extends beyond each side of the horizontal base 526, and is sized to engage top funnel slot 446 of the channel 402 of the interface 300, as it will become apparent below.

The foot propulsion mechanism 500 also comprises the flexible flappers 542*a*, 542*b* each adapted to oscillate through an arcuate path in a generally transverse direction with respect to the longitudinal axis $L_1$-$L_1$, about a rotation axis $R_2$-$R_2$ which is at or below the bottom of the hull 24 of the kayak 10 when the propulsion mechanism 500 is mounted to the interface 300. More specifically, the flexible flappers 542*a*, 542*b* are carried by a shaft 562 extending generally longitudinally and rotatably mounted to the core support 514 via the three flapper mounting brackets 546*a*-546*c*. The flappers 542*a*, 542*b* are operatively coupled to the mounting brackets 518*a*, 518*b* of the pedals 502*a*, 502 via the cable and chain transmission 540, which include a pulley 564 mounted to the pulley mounting brackets 558*a*, 558*b*, chains 566*a*, 566*b* engaging sprockets (not shown) mounted to the shaft 562 and cables 568 connecting the chains 566*a*, 566*b* to the mounting brackets 518*a*, 518*b*. While in the illustrated embodiment the propulsion system 500 is a foot propulsion system, it will be understood that it could also be operated by hand.

Figure 31:
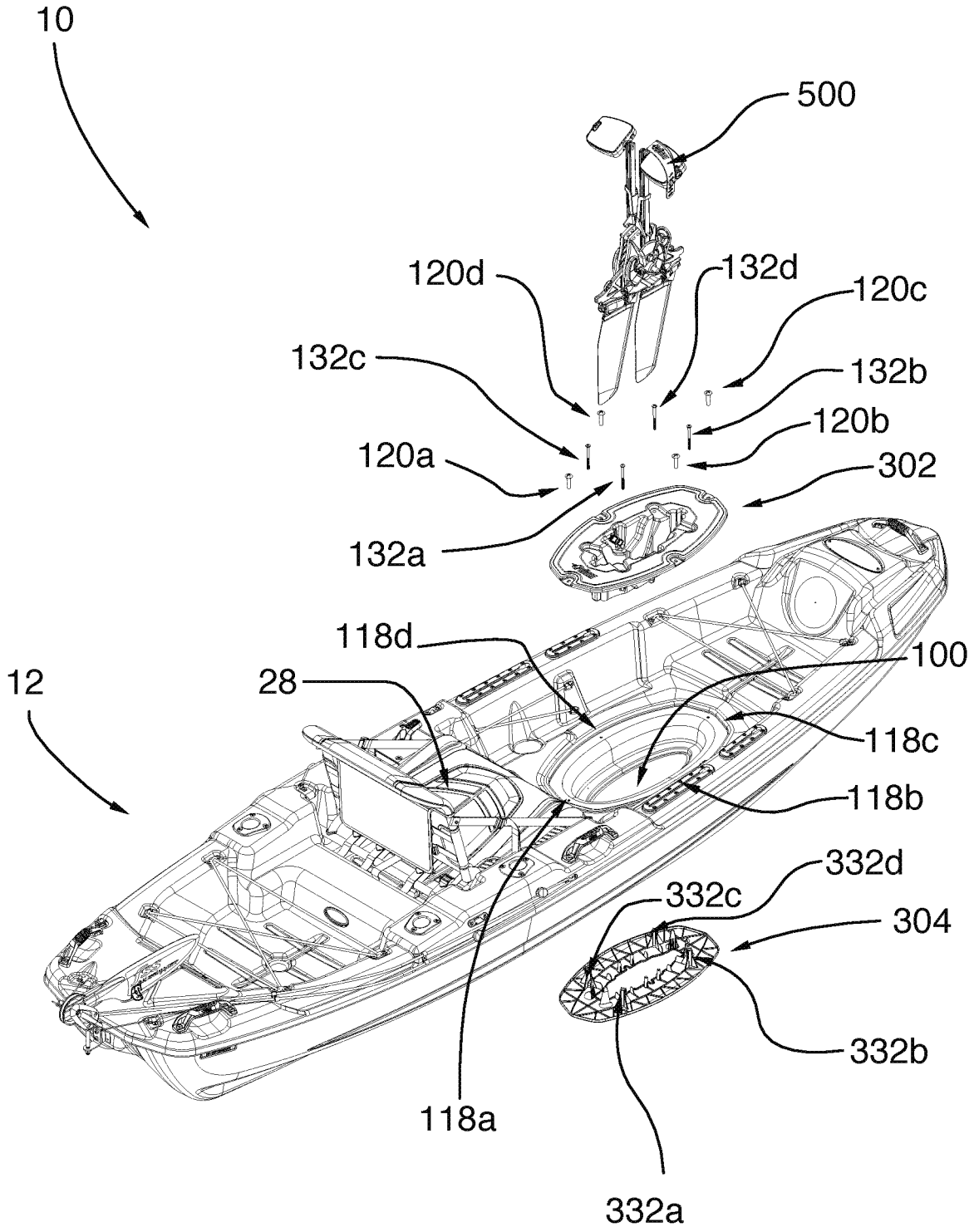
FIG. 31 is a rear, top right, partially exploded view of the kayak shown in FIG. 1.

Having described the general components of the kayak 10 and of the interface 300, their assembly will now be described, with reference to FIG. 31. The body 12 of the kayak 10 may be manufactured using any suitable process, including without being limited to, thermoforming processes, blowmolding processes and rotomolding process. In a specific practical implementation, the body 12 of the kayak 10 may be manufactured by molding two sheets of extrudable material using a thermoforming process to shape the two manufactured sheets into a kayak shape of the type described in the present document, one sheet being used for the top side (i.e. the deck 20) and the other for the bottom side (i.e. the hull 24) of the kayak 10. Examples of the different types of thermoplastics that can be extruded include: LDPE, HDPE, ABS, polystyrene, polypropylene, acetates, butyrates, nylons, polyphenylene sulfides, acetals, polycarbonates and thermoplastic rubbers and polyesters, among other possibilities. As it will be appreciated, the well 100 of the kayak 10 may be closed when the deck 20 and hull 24 emerged from the mold after welding. As such, the manufacturing of the kayak 10 may require an opening to be defined in the well post-molding. Typically, such an opening will be carried out by a worker using a cutting tool such as a rotary saw. As it will be understood, the shape of the well (i.e. a generally oblong shape) greatly simplify the cutting of the opening as compared to a more complex hole shape, thereby facilitating the manufacturing of the kayak 10.

The interface 300 is then mounted to the body 12 of the kayak 10, by first positioning the lower portion 302. To do so, the snapfits 324*a*-324*d* and fastening projections 332*a*-332*d* are engaged in the oblong well 100 of the body 12, and is forced upwardly until the snapfits 324*a*-324*d* engage the lip 138 of the third portion 106 of the well 100, thereby partially securing the lower portion 302 of the interface 300 to the body 12. When the lower portion 302 is engaged in the well 100 in such a position (i.e. when the snapfits 324*a*-324*d* engage the lip 138), the fastening projections 332*a*-332*d* abut the abutment wall 142 of the fourth portion 108 of the well 100, and the threaded bores 366*a*-366*d* of the fastening projections 332*a*-332*d* are aligned with holes 130*a*-130*d*. Furthermore, in such a position, the plate 306 is receive in the recess 152 defined by the peripheral wall 148 and the abutment wall 150 of the fifth portion 110 of the well 100, while the female portions 334*a*-334*d* of the directing assembly 336, the guiding fins 334*a*-334*d*, the fins 354 of the fastening portions 332*a*-332*d*, the fins 376 of the female portions 334*a*-334*d* and the elongated hole 312 are vertically aligned with the open portion of the well 100.

The top portion 304 of the interface 300 is then assembled by positioning the top portion 304 in vertical alignment with the well 100 and gradually lowering down until the top plate 400 is completely received in the recess 116 defined by the peripheral wall 112 and the abutment wall 114 of the first portion 102 of the well 100. To properly position the lower end 403 of the channel 402 in alignment with the elongated hole 312 of the lower portion 302, a male portions 390*a*-390*d* of the guide assembly 336 gradually engages female portions 334*a*-334*d* of the directing assembly 336, while the bottom end 403 of the channel 402 gradually engages the inclined edges 358, 380, 394, and then the vertical edges 356, 378, 392 of the guiding fins 334*a*-334*d*, the fins 354 of the fastening portions 332*a*-332*d*, the fins 376 of the female portions 334*a*-334*d*. As such, the directing assembly 336 and the guiding fins 334*a*-334*d*, the fins 354 of the fastening portions 332*a*-332*d* and the fins 376 of the female portions 334*a*-334*d* define a guiding assembly and assist in properly aligning the top and bottom portions 302, 304 of the interface 300 during their assembly with the body 12 of the kayak 10.

When the top portion 304 of the interface 300 is properly positioned relative to the lower portion 302 of the interface 300 and to the body 12 of the kayak 10, the fastening projections 462*a*-462*d* of the top portion 304 are received in the recesses 146*a*-146*d* of the abutment wall 128 of the third portion 106. Threaded fasteners 132*a*-132*d* are then sequentially engaged into holes 418*a*-418*d* found in the recesses 416*a*-416*d* of the top portion, in holes 130*a*-130*d* of the of abutment wall 128 and in threaded bores 366*a*-366*d* fastening projections 332*a*-332*d*, thereby securing the top portion to the body 12 of the kayak 10 and to the lower portion 302 of the interface 300. As it will be appreciated, in this position, the abutment wall 128 of the body 12 is sandwiched between the fastening projections 332*a*-332*d* and 462*a*-462*d* of the lower and upper portions 302, 304, respectively.

To further secure the interface 300 to the body 12, threaded fasteners 120*a*-120*d* are engaged in the oblong holes 414*a*-414*d* defined in the recesses 412*a*-412*d* of the top portion 304, and in the vertically aligned holes 118*a*-118*d* of the body 12, until the head of the fasteners 120*a*-120*d* are received in the recesses 412*a*-412*d*, to complete the assembly of the interface 300 with the body 12 of the kayak 10.

While in the illustrated embodiment the interface 300 is mounted to the body 12 of the kayak 10 using four fasteners 120*a*-120*d* engaging the top portion 304 of the interface and the body 12, and four fasteners 132*a*-132*b* engaging the top portion 304 and the bottom portion 302 of the interface, it will be understood that the interface 300 could be mounted to the body 12 of the kayak differently, for instance by using a different number of fasteners, by positioning the fasteners in other locations or by using other types of fasteners (e.g. rivets). As such, the person skilled in the art will appreciate that the number of projections extending from the top and bottom portions of the interface 300, as well as the number and position of the recesses can be adjusted accordingly.

Further, as it will be appreciated, the description of the assembly of the interface 300 with the body 12 of the kayak 10 assumes that the kayak 10 is assembled with the deck 20 in an upside position and the hull 24 in a downside position. As it will be appreciated, the assembly of the interface 300 with the body 12 could be carried out by positioning the body 12 of the kayak upside/down or in any other position. As such, the referring to moving the various elements up or down is in no way intended to limit assembly steps of the kayak 10.

It will also be appreciated that since the interface is secured to the body 12 of the kayak 10 using threaded fasteners and snapfits 324*a*-324*d*, the interface 300 can be removed from the body 12. This may prove advantageous for instance where the operation of the foot propulsion mechanism 500 over time has created damages or weaknesses to the interface 300. Thus, the interface 300 can be replaced with another interface, thus avoiding the need to replace the entire body of the kayak 10 while ensuring continuous structural integrity of the kayak 10 and the optimum use of the foot propulsion mechanism 500.

Once the interface 300 is properly mounted to the body 12, the user has the possibility to removably mount the foot propulsion mechanism 500 to the interface 300, for instance when the kayak 10 is floating on a water surface. To do so, the user engages the lower part of the flappers 542*a*, 542*b* into the channel 402 of the top portion 304, and gradually lowers down the foot propulsion mechanism 500. When the core support 514 of the foot propulsion mechanism gradually engages the channel 402, the left and right transverse projections 548*a*, 548*b* engage lower funnel-shape slots 444 while the shaft 524 engages the top funnel slot 446. As the foot propulsion mechanism 500 is further lowered down, the shaft 524 forces the lock 450 pivotably mounted in the lock receiving recess 448 toward their unlock position, until the shaft 524 reaches its position in the top funnel slot 446. In such position, the lock 450 are allowed to pivot back to their lock position, where the convex lower end 454 of the lock 450 engage the shaft 524 to prevent unwanted removal of the foot propulsion mechanism 500. Furthermore, when the foot propulsion mechanism 500 is properly positioned in the interface 300, the resting surfaces 554,556 provided at the front and rear ends 550, 552 of the upright mounting support 544 of the core support 514 lie on the abutments 432, 434 of the front and rear slots 428, 430 defined in the channel 402, while the shaft 562 and the flappers 542*a*, 542*b* extend below the hull 24. As it will be appreciated, the left and right transverse projections 548*a*, 548*b*, the shaft 524 and the front and rear ends 550, 552 of the upright mounting support 544, as well as the shape of the horizontal base 526 of the core support 514 (which substantially correspond to the shape of the channel 402), collaborated with the various portions of the interface 300 to prevent movement of foot propulsion mechanism 500 relative to the interface 300 during the operation.

When the user wants to remove the foot propulsion mechanism 500 from the interface 300, for instance to facilitate transport of the kayak 10, the user forces the locks 450 toward their unlock position by engaging the grip elements 458 at the concave upper ends 456, thereby allowing the shaft 524 to travel upwardly in the channel 402. The user then pulls on the foot propulsion mechanism 500 to disengage the same from the interface 300.

While the kayak 10 has been described in connection with the embodiment illustrated in FIGS. 1 to 31, it will be understood that variations are possible without departing from the scope of the invention. For instance, while the interface 300 and foot propulsion mechanism 500 are described in connection with a kayak 10 provided with a single seat 28, they could also be used in connection with a tandem kayak, or with any other type of watercraft, including small boats, a paddleboards and pedal boats. Likewise, while the foot propulsion mechanism 500 described in the illustrated embodiment is an oscillating flapper propulsion system, it will be understood that the interface 300 could be used in conjunction with other types of propulsion mechanisms, such as hand operated propulsion mechanisms, motorised propulsion mechanisms such as electric motors and gas motors, whether they are of the flapper oscillating type, propeller type or blade type. Furthermore, the interface 300 could be used in conjunction with a plug configured to be received in the channel 402 and concealing the elongated hole 312 of the interface 300 when no propulsion mechanism is used, for instance when the user propels the kayak 10 with paddles.

Furthermore, while the kayak 10 has been described in connection with the interface 300 shown in FIGS. 11 to 26, it will be understood that other interface configurations are possible without departing from the scope of the invention. For instance, while the channel 412 extends from the top portion 304 and the elongated hole 312 is defined in the bottom portion 302, the channel (e.g. channel 412) could extend upwardly from a bottom portion (e.g. bottom portion 302) while the elongated hole (e.g. elongated hole 312) and the fins (e.g. fins 338*a*-338*d*, 354*a*-354*d* and 376) could be defined or extend from the top portion (e.g. top portion 304).

It will also be understood that an interface could be configured to comprise only one of the top and bottom portions (e.g. top portion 304 or bottom portion 302), from which would extend a channel (e.g. channel 412), either downwardly (in the case of a top portion) or upwardly (in the case of a bottom portion). In such cases, the top or bottom portion would be secured to the body 12 of the kayak 10 using fasteners engaging the top or bottom portion, and the body 12 of the kayak. Taking top portion 304 as an example, to secure the interface constituted by the top portion 304 to the body 12, threaded fasteners 120*a*-120*d* would be engaged in the oblong holes 414*a*-414*d* defined in the recesses 412*a*-412*d* of the top portion 304, and in the vertically aligned holes 118*a*-118*d* of the body 12, until the head of the fasteners 120*a*-120*d* are received in the recesses 412*a*-412*d*, to complete the assembly of the top portion 304 with the body 12 of the kayak 10.

Alternatively, the interface could be provided with both a bottom portion (e.g. bottom portion 302) and a top portion (e.g. top portion 304), but mounted to the body 12 of the kayak 10 differently than interface 300. For instance, the bottom and top portions could have no fastening projections (e.g. fastening projections 332*a*-332*d* and 462*a*-462*d*), in which case the top and bottom portions would be secured to the body 12 of the kayak 10 by using threaded fasteners engaging either the bottom portion and the body 12 of the kayak, or the top portion and the body 12 of the kayak. Alternatively, various arrangements of snapfits could be used.

The embodiments described above are intended to be exemplary only. The scope of the invention is therefore intended to be limited solely by the appended claims.

The invention claimed is:

1. A kayak comprising:

a substantially rigid body having a deck side, a hull side, and a well extending through the deck side and the hull side;

an interface for mounting a foot-driven propulsion mechanism to the substantially rigid body, the interface including:

a first portion near to the hull side or the deck side, the first portion comprising a first hole for allowing passage of a portion of the foot-driven propulsion mechanism therethrough;

a second portion near to the other of the hull side or the deck side on an opposite side of the well from the first portion, the second portion comprising a second hole for allowing passage of a portion of the foot-driven propulsion mechanism therethrough, wherein the second portion is a separate component from at least the first portion; and a channel structure disposed in the well between the first portion and the second portion, the channel structure being sized and shaped for allowing passage of a portion of the foot-driven propulsion mechanism therethrough and for removably securing the foot-driven propulsion mechanism to the interface.

2. The kayak of claim 1, wherein the channel structure is integrally formed with, and extends away from, the first portion.

3. The kayak of claim 2, wherein a distal edge of the channel structure is received within a recess formed in the second portion.

4. The kayak of claim 1, wherein the interface further comprises at least one guide extending from the second portion to align the channel structure with the second hole of the second portion.

5. The kayak of claim 4, wherein the at least one guide defines a lip for receiving a portion of the channel structure thereon.

6. The kayak of claim 5, wherein the lip extends at least partially around a periphery of the second hole of the second portion.

7. The kayak of claim 6, wherein the lip extends entirety around the periphery of the second hole of the second portion.

8. The kayak of claim 1, wherein the interface and the substantially rigid body of the kayak are formed by different plastic molding processes.

9. The kayak of claim 1, further comprising a fastener for coupling the interface to the kayak, wherein the fastener is at least one projection and a corresponding recess.

10. The kayak of claim 1, further comprising a fastener for coupling the interface to the kayak, wherein the fastener comprises screws and corresponding holes.

11. The kayak of claim 10, wherein the screws and holes couple the interface together to sandwich the kayak between the first and second portions.

12. The kayak of claim 10, wherein the screws couple the interface to holes in the kayak.

13. The kayak of claim 9, wherein the fastener is a snapfit.

14. The kayak of claim 1, wherein the interface is removably coupled to the kayak.

15. The kayak of claim 1, further comprising drainage holes in the interface through which water can drain.

16. The kayak of claim 1, wherein the kayak further comprises the foot-driven propulsion mechanism and a lock mechanism disposed in the channel structure, the lock mechanism being movable between an unlocked position where vertical movement of the foot-driven propulsion mechanism relative to the channel structure is allowed, and a locked position where vertical movement of the foot-driven propulsion mechanism relative to the channel structure is prevented.

17. A kayak comprising:

a substantially rigid body having a deck side, a hull side, and a well extending through the deck side and the hull side;

an interface for mounting a foot-driven propulsion mechanism to the substantially rigid body, the interface including:

a first portion near to the deck side of the kayak;

at least one channel structure extending from the first portion, the channel structure disposed in the well, the channel structure being sized and shaped for receiving therein at least a portion of the foot-driven propulsion mechanism and for removably securing the foot-driven propulsion mechanism to the interface; and a fastener configured to couple the interface to the kayak.

18. The kayak of claim 17, wherein the first portion at least partially encircles the deck side of the well.

19. The kayak of claim 17, wherein the channel structure is integrally formed with the first portion.

20. The kayak of claim 17, wherein the interface and the substantially rigid body of the kayak are formed by different plastic molding processes.

21. The kayak of claim 17, further comprising an abutment wall adjacent the well, the abutment wall extending horizontally and having one or more holes defined therein, the one or more holes each configured to receive therethrough a corresponding fastener for securing the first portion to the kayak.

22. The kayak of claim 21, wherein the one or more holes comprise one or more threaded holes, and the corresponding fastener comprises a screw.

23. The kayak of claim 21, further comprising a lock mechanism disposed in the channel structure and being movable between an unlocked position and a locked position to prevent vertical movement of the foot-driven propulsion mechanism relative to the channel structure.

24. The kayak of claim 17, further comprising a second portion positioned near the hull side on an opposite side of the well from the first portion, where the second portion comprises a hole sized and shaped for receiving therethrough a portion of the foot-driven propulsion mechanism, the hole being aligned with the well, wherein a distal edge of the channel structure is received within a recess formed in the second portion.

25. The kayak of claim 24, wherein the second portion at least partially encircles the well.

26. The kayak of claim 24, wherein the fastener couples the first portion to the second portion to sandwich the kayak between the first and second portions.

27. The kayak of claim 17, wherein the fastener is a snapfit.

28. The kayak of claim 17, wherein the interface is removably coupled to the kayak.

29. The kayak of claim 17, further comprising drainage holes in the interface through which water can drain.

30. The kayak of claim 1, wherein at least one of the first portion and the second portion at least partially encircles the deck side of the well.

31. The kayak of claim 1, wherein the deck side is substantially horizontal and parallel to a water surface when the kayak is in normal use.

* * * * *